US010966552B2

(12) United States Patent
Durfee

(10) Patent No.: US 10,966,552 B2
(45) Date of Patent: Apr. 6, 2021

(54) CUSHIONING POSTERIOR FULCRUM BACK SHAPER

(71) Applicant: Creatrix Solutions LLC, Kennewick, WA (US)

(72) Inventor: Eileen Durfee, Kennewick, WA (US)

(73) Assignee: CREATRIX SOLUTIONS LLC, Kennewick, WA (US)

( * ) Notice: Subject to any disclaimer, the term of this patent is extended or adjusted under 35 U.S.C. 154(b) by 161 days.

(21) Appl. No.: 16/368,243

(22) Filed: Mar. 28, 2019

(65) Prior Publication Data

US 2019/0223632 A1 Jul. 25, 2019

Related U.S. Application Data

(63) Continuation-in-part of application No. PCT/IB2017/055986, filed on Sep. 28, 2017.

(Continued)

(51) Int. Cl.
*A47G 9/10* (2006.01)
*A63B 21/078* (2006.01)

(Continued)

(52) U.S. Cl.
CPC ..... *A47G 9/1045* (2013.01); *A47C 7/383* (2013.01); *A47C 7/425* (2013.01); *A47C 20/027* (2013.01);

(Continued)

(58) Field of Classification Search
CPC ... A63B 23/00; A63B 21/4027; A63B 21/078; A63B 21/072; A47G 9/1081;

(Continued)

(56) References Cited

U.S. PATENT DOCUMENTS 2,835,905 A * 5/1958 Tomasson ..... A47G 9/10 5/632
2,839,766 A * 6/1958 Hull ..... A47C 20/026 5/632

(Continued)

FOREIGN PATENT DOCUMENTS

CA 2851343 A1 * 4/2012 ..... A47G 9/10
CN 105664441 A * 6/2016

(Continued)

*Primary Examiner* — David R Hare
*Assistant Examiner* — Alexis Felix Lopez

(57) ABSTRACT

A cushioning posterior fulcrum back shaper is an apparatus that supports and guides the back and neck of a user. The apparatus encourages the proper form throughout stretches and exercises, positioning each engaged body parts. The apparatus includes a back shaper that supports the arch of the back, and a neck shaper which supports the spine of the user, and consequently the neck. The first grooved channel positions and guides the spine. The back shaper includes a semicircular prismatic body, a sacrum-supporting depression, and a pelvis-supporting depression. The neck shaper includes an elongated body, a first interlocking arm, and a second interlocking arm. The semicircular prismatic body supports the arch of the back. The sacrum-supporting depression and the pelvis-supporting depression position the sacrum and the sacrum and head, respectively. The elongated body is rotatably mounted to the semicircular prismatic body with the first interlocking arm and the second interlocking arm.

20 Claims, 19 Drawing Sheets

Related U.S. Application Data

(60) Provisional application No. 62/400,964, filed on Sep. 28, 2016.

(51) Int. Cl.

| | |
|---|---|
| ***A63B 23/00*** | (2006.01) |
| ***A63B 21/072*** | (2006.01) |
| ***A63B 21/00*** | (2006.01) |
| ***A47C 7/38*** | (2006.01) |
| ***A47C 7/42*** | (2006.01) |
| ***A47C 20/02*** | (2006.01) |

(52) U.S. Cl.
CPC ..... *A47G 9/1081* (2013.01); *A63B 21/072* (2013.01); *A63B 21/078* (2013.01); *A63B 21/4027* (2015.10); *A63B 23/00* (2013.01)

(58) Field of Classification Search
CPC .... A47G 9/1045; A47C 20/027; A47C 7/425; A47C 7/383
See application file for complete search history.

(56) References Cited

U.S. PATENT DOCUMENTS 4,233,700 A * 11/1980 Spann ..... A47C 20/027 5/632
4,876,755 A * 10/1989 Parrish ..... A47C 7/425 297/284.3
4,951,334 A * 8/1990 Maier ..... A61G 5/1043 297/452.21
4,987,625 A * 1/1991 Edelson ..... A47C 20/026 5/420
5,214,814 A * 6/1993 Eremita ..... A47G 9/109 5/632
5,432,967 A * 7/1995 Raftery ..... A47C 16/005 5/633
5,452,940 A * 9/1995 Maier ..... A47C 7/46 297/452.32
5,727,267 A * 3/1998 Keilhauer ..... A47G 9/109 5/632
D449,484 S * 10/2001 Berke ..... D6/601
6,513,179 B1 * 2/2003 Pan ..... A47G 9/109 5/636
D523,275 S * 6/2006 Hawkins ..... D6/601
8,161,588 B1 * 4/2012 Anson ..... A47G 9/109 5/636
8,591,388 B2 * 11/2013 Jahns ..... A63B 23/0211 482/140
D808,195 S * 1/2018 Wyborn ..... D6/601
2002/0091342 A1 * 7/2002 Tsai ..... A47C 7/383 601/134
2013/0232693 A1 * 9/2013 Myers ..... A47C 7/383 5/636
2013/0298333 A1 * 11/2013 Chen ..... A47G 9/1081 5/636
2015/0351564 A1 * 12/2015 Vogel ..... A47G 9/1081 5/640

FOREIGN PATENT DOCUMENTS

DE 2618519 A1 * 11/1977 ..... A47C 20/027
FR 2882904 A1 * 9/2006 ..... A47C 3/16
GB 792404 A * 3/1958 ..... B60N 2/7005

* cited by examiner

CUSHIONING POSTERIOR FULCRUM BACK SHAPER

The current application claims a priority to the Patent Cooperation Treaty (PCT) application serial number PCT/IB2017/055986 filed on Sep. 28, 2017 and the U.S. Provisional Patent application Ser. No. 62/400,964 filed on Sep. 28, 2016.

FIELD OF THE INVENTION

The present invention relates generally to a back support. More specifically, the present invention is cushioning lumbar and cervical shaper that correctly aligns the back and neck of a user. The present invention provides posterior support of the back and neck of the user while performing a variety of stretches and exercises in a supine position.

BACKGROUND OF THE INVENTION

Humans are unique in many aspects when compared to any other species. One of the defining traits of the humans is an exclusive S-shaped posture. The vertebral column is one of the most important parts of our musculoskeletal system. Effective mobility is defined with the ability to sit upright and move on two legs, with respect to the effect of gravity. The human backbone houses the spinal cord, which serves as the main pathway connecting the brain to the nervous system. Due to the overall complexity of the spine, even light damage can cause serious medical issues, that can lead to constant pain, and in more severe cases even paralysis. Generally, serious injuries occur due to physical trauma to the backbone area. However other factors, such as prolonged improper posture, can have a major impact as well. A plurality of issues can be caused by an improper posture, leading to constant pain and discomfort as a result of weakening muscles in the musculoskeletal structure. Poor posture differs from person to person. Individuals may be more susceptible to poor posture depending on body type and genetics.

The best way to ensure comfortable long-term living is to maintain a correct posture. Back pain can be self-inflicted due to a lifetime of bad habits, that is why understanding and maintaining an accurate posture that maintains the natural shape of the vertebral column is very important. The spine is not only responsible for support and movement, but it is one of the key factors that ensures proper function of the nervous system. Humans are born with what is known as a C-shaped curve. Development, during infancy leads to the lifting of the head and the curve in the neck starts to form forward thus creating the defining unique shape of the backbone. Some of the more important roles of the vertebral column are protection, support, and movement. The vertebrae which make up the vertebral structure of the spinal cord, allow it to conduct these functions.

The present invention aims to create an improved way of reshaping the vertebral column, by applying opposing forces anteriorly and posteriorly to the spine without the need for complex equipment that can only be found at a specialized facility. The present invention is positioned onto any flat supporting surface for use with the body in the supine position. A plurality of factors is the cause for the deformation of the vertebral column. Some of the more common ones occur through aging, repetitive motion injuries, physical trauma or as mentioned above continuous incorrect posture. Incorrect posture not only affects the shape of the backbone but it can also weaken and/or strengthen certain muscles. Weakened muscles leading to the loss of the spinal curvature, can disable the human body, especially the back. Restoring the S-shaped curvature in the human spine, can act as an effective permanent pain relief method for a plurality of medical conditions, therefore directly improving the quality of life.

DETAILED DESCRIPTION OF THE INVENTION

All illustrations of the drawings are for the purpose of describing selected versions of the present invention and are not intended to limit the scope of the present invention.

Figure 1:
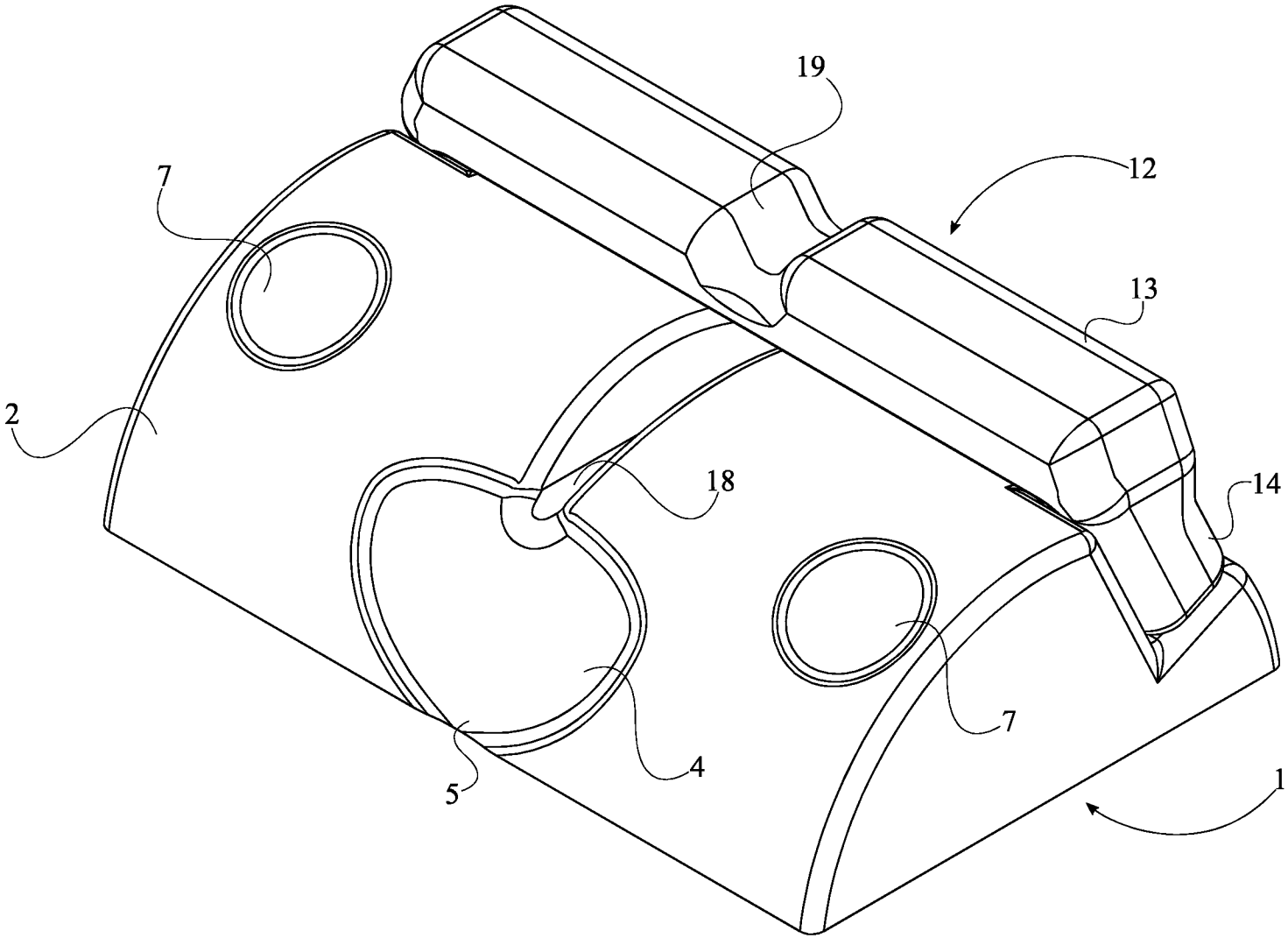
FIG. 1 is a perspective view of the present invention, wherein the first interlocking arm and the second interlocking arm are in an upright configuration.
Figure 8:
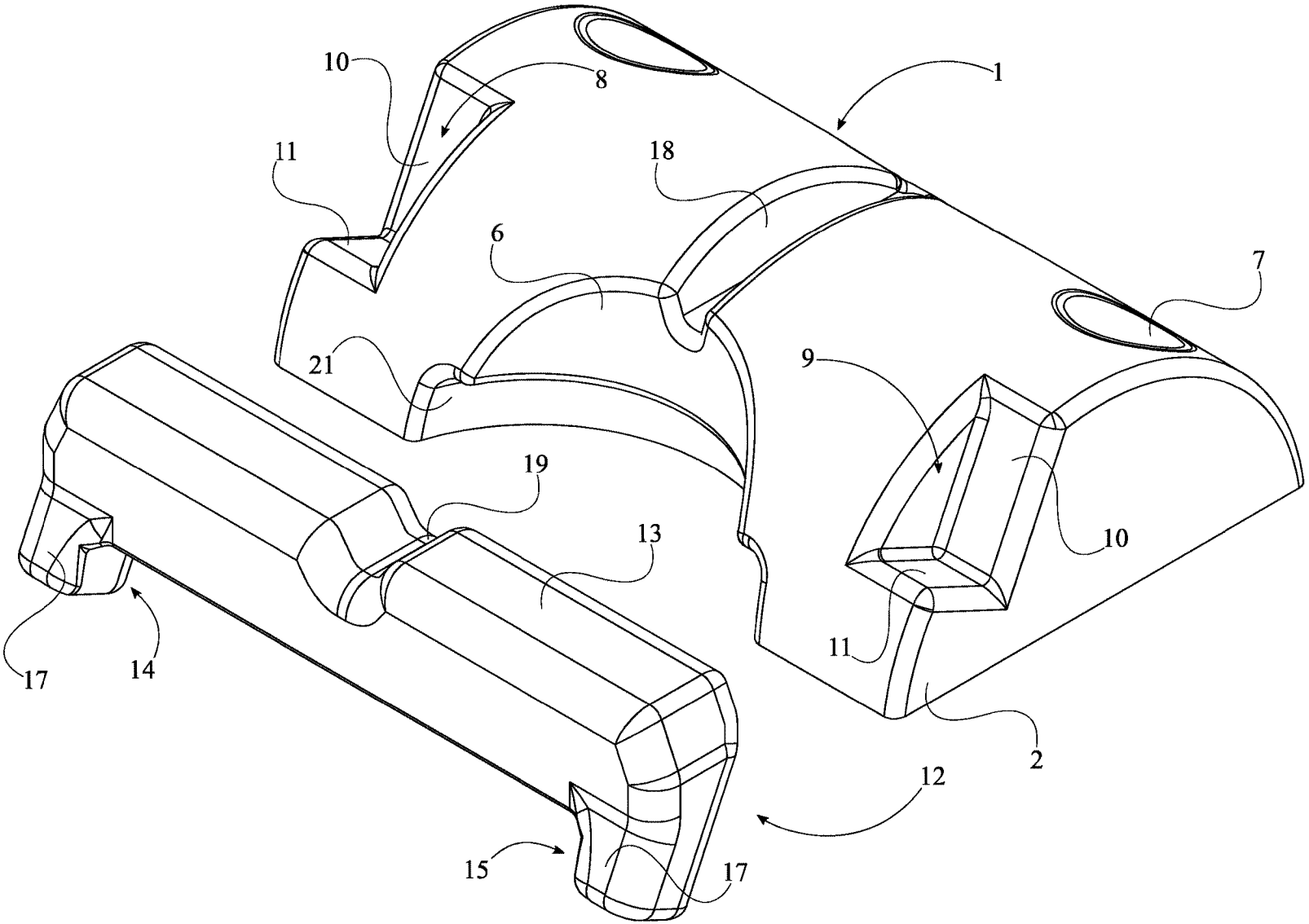
FIG. 8 is a rear exploded view of the present invention.
Figure 9:
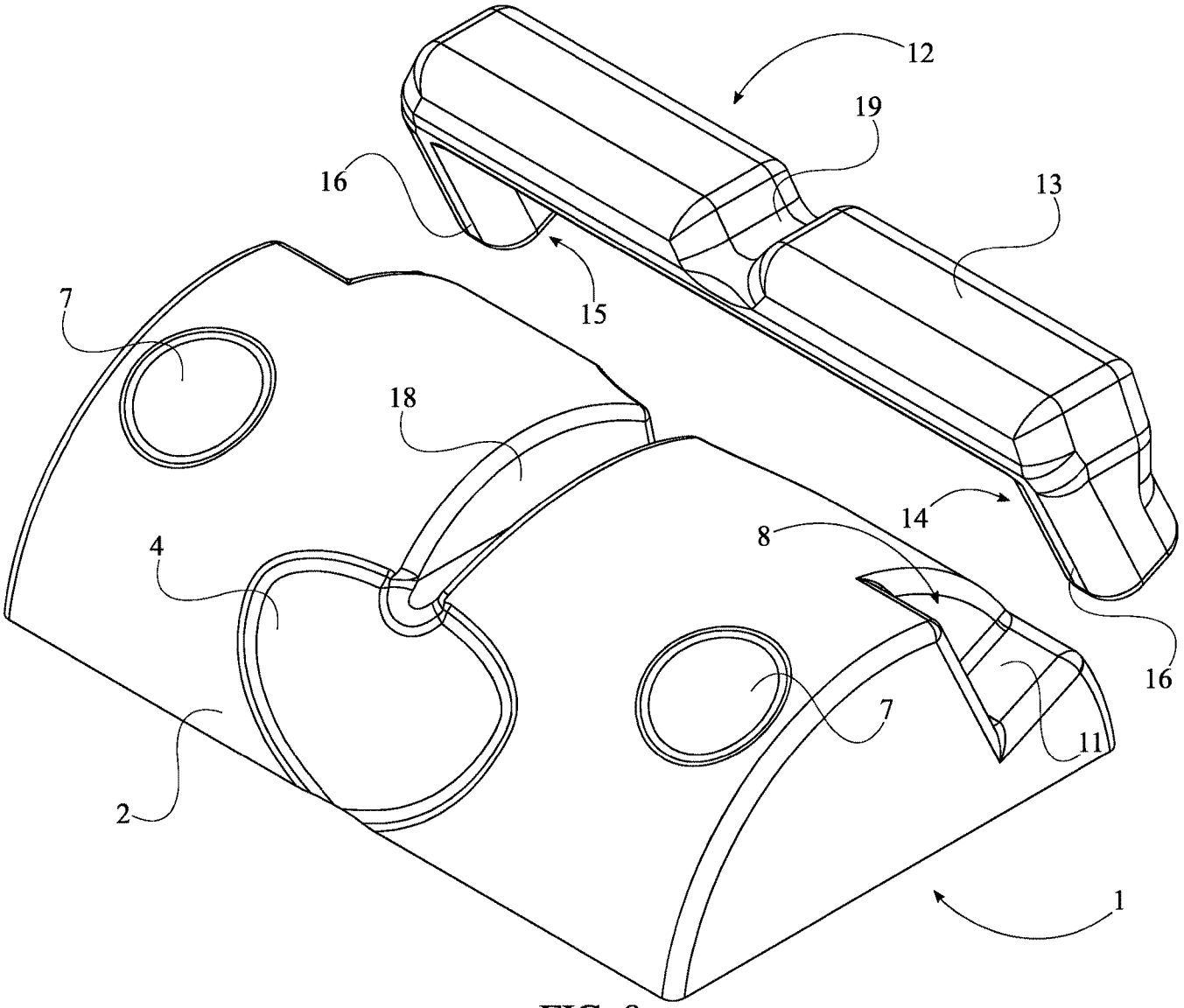
FIG. 9 is a front exploded view of the present invention.
Figure 10:
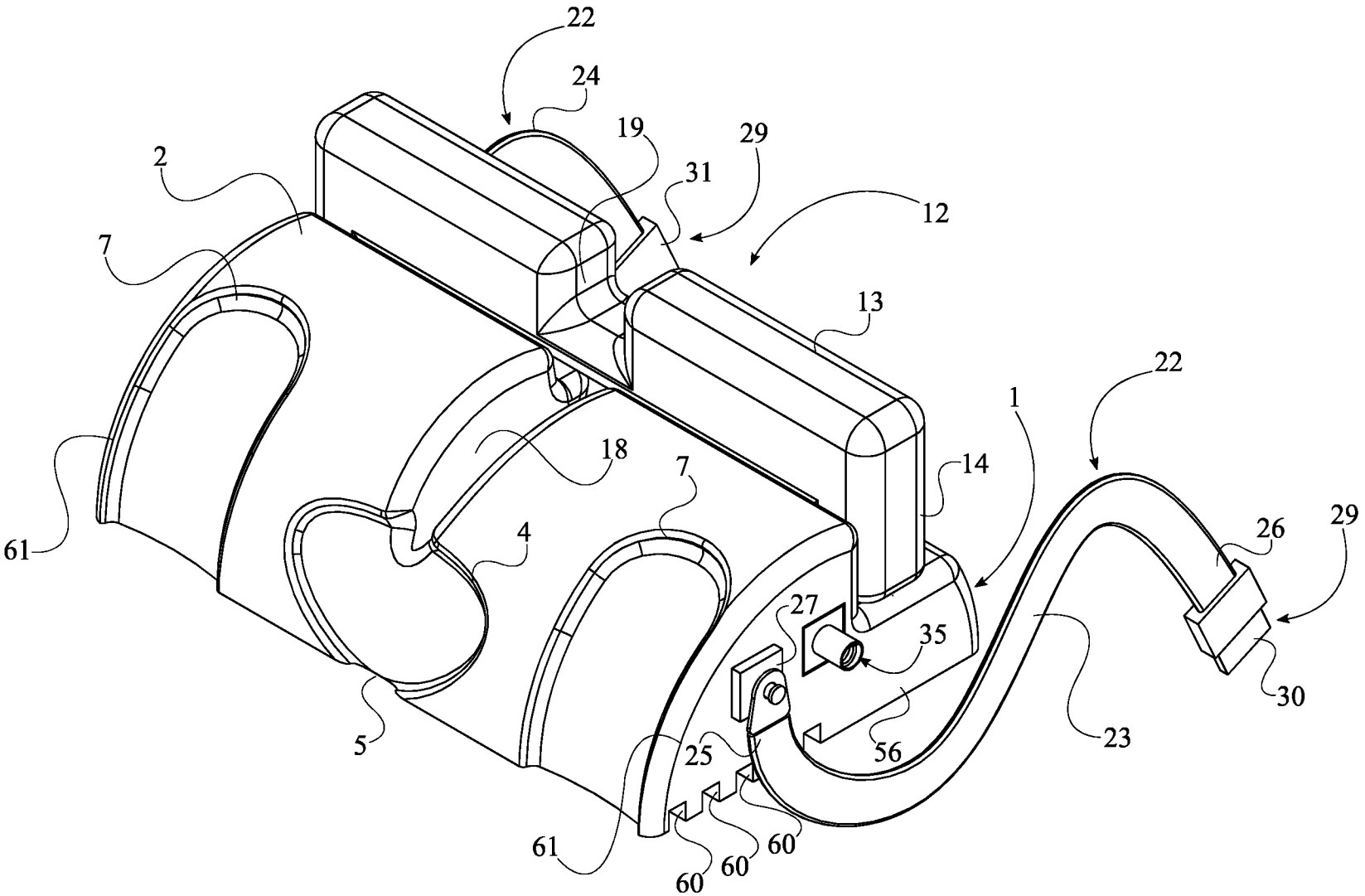
FIG. 10 is a perspective view of an alternate embodiment of the present invention, wherein the first interlocking arm and the second interlocking arm are in an upright configuration.

The present invention is a cushioning posterior fulcrum back shaper 1 that encourages proper form. The present invention supports the spinal transverse processes of the vertebrae while a user performs stretches and exercises in a supine position. The present invention supports moving parts of the neck and back as the user is moving. The present invention strengthens the user by forcing the user to use the proper muscles while stretching or exercising. The present invention aids the user preferably while performing sit-up exercises, pelvic-thrusting exercises, and bridge poses. In order to support the back and the neck of the user, the present invention comprise a back shaper 1, a neck shaper 12, and a first grooved channel 18, as seen in FIG. 1. The back shaper 1 comprises a semicircular prismatic body 2, a sacrum-supporting depression 4, and a pelvis supporting depression 6. Where the back shaper 1 is positioned further up the back of the user and the neck shaper is separated from the back shaper, as seen in FIG. 8 and FIG. 9, the back shaper 1 uplifts the arch of the lower back. The sacrum-supporting depression 4 centers the pelvis of the spinal column while performing a sit-up exercise. The sacrum-supporting depression 4 also stabilizes and centers sacrum, aligning spinal column with first grooved channel 18. The semicircular prismatic body 2, uplifts the arch of the lower back. More specifically, the semicircular prismatic body 2 contacts posterior sacrum of user and defines the form of the arch of the back. Furthermore, the sacrum-supporting depression 4 positions and supports the sacrum, and first grooved channel 18 positions and supports the spine throughout the stretching and exercising motions of the user.

Where the back shaper 1, seen in FIG. 8 and FIG. 9 separated from the neck shaper 12, is positioned further down the back of the user and the neck shaper is separated from the back shaper, the back shaper 1 uplifts and supports the posterior side of user buttocks and hips. The pelvis-supporting depression 6 holds and stabilizes the edges of pelvic girdle hip bones and opens the pelvic girdle hip bones without any support under sacral bones. The pelvis supporting depression 6, simultaneously stabilizes pelvis and allows movement of sacral bones. The semicircular prismatic body 2 contacts and centers the posterior buttocks and hips of the user while performing a pelvic tilt exercise. Consequently, the stabilized pelvic girdle hip bones positioned on top of the pelvis-supporting depression 6 are free to move during the musculature contraction and relaxation of a pelvic tilt exercise.

The cervical bones of the user are supported and guided throughout any movement where the neck shaper 12 is interlocked into semicircular prismatic body 2, as shown in FIG. 1, FIG. 2, FIG. 3, and FIG. 4. The neck shaper 12 supports and guides the neck during a neck flexion position as seen in a bridge pose. In order to achieve the bridge pose, the user bridges the back, positions and stretches over elongated body 13, while lowering back bridge stretching whole spine across the back shaper 1. In order to effectively support the neck during a neck flexion position, the neck shaper 12 comprises an elongated body 13, a first interlocking arm 14, and a second interlocking arm 15. The elongated body 13 directly supports the neck. Both the first interlocking arm 14 and the second interlocking arm 15 allows the elongated body 13 to be fixed in an upright configuration and a rested configuration, while continuously supporting and guiding the neck of the user throughout any movement.

Figure 2:
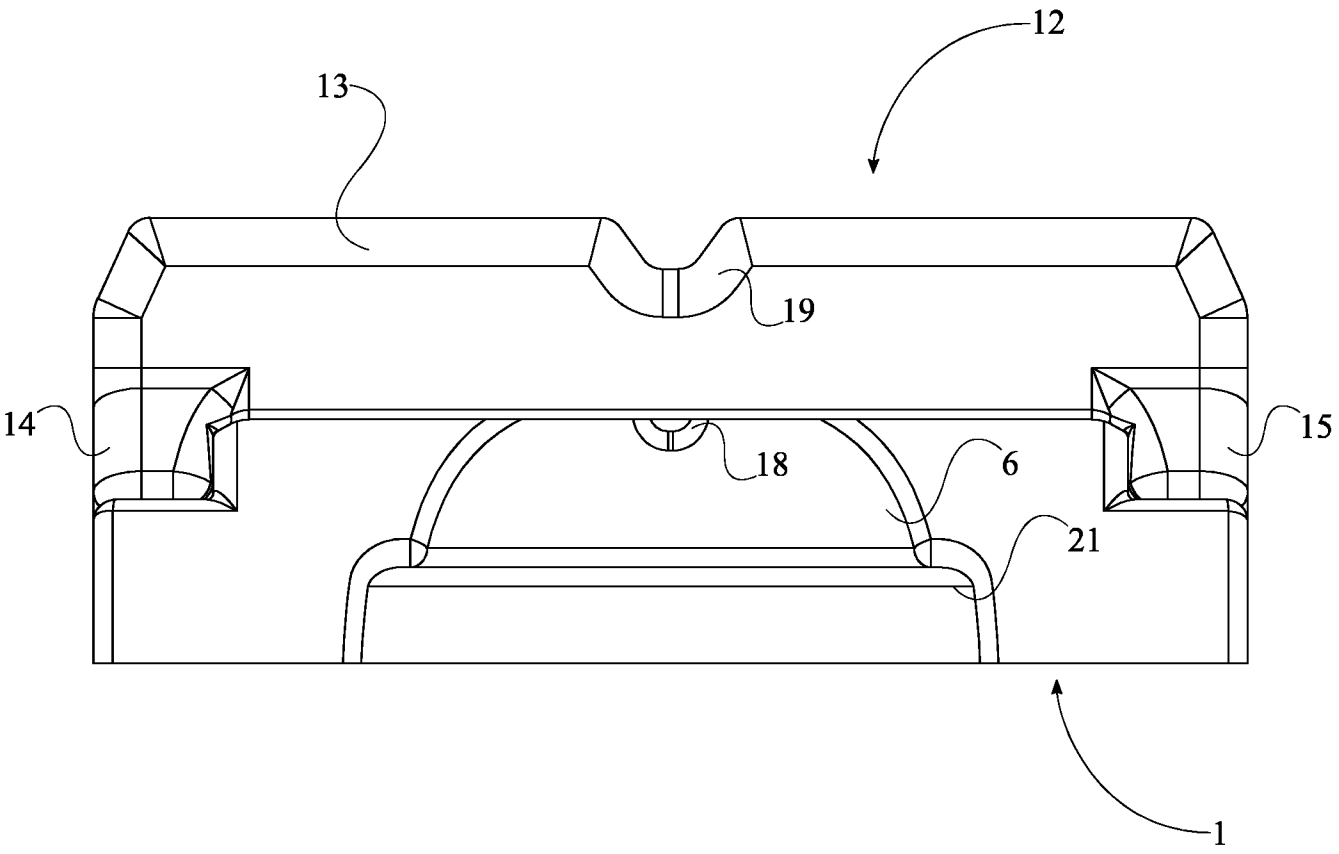
FIG. 2 is a rear side view of the present invention, wherein the first interlocking arm and the second interlocking arm are in an upright configuration.

The overall configuration of the aforementioned components allows the user to perform a variety of movements in a supine position in the correct form. The sacrum-supporting depression 4 and the pelvis-supporting depression 6 are integrated into a rounded lateral surface 3 of the semicircular prismatic body 2, illustrated in FIG. 1, FIG. 8, and FIG. 9. More specifically, the sacrum-supporting depression 4 and the pelvis-supporting depression 6 are positioned opposite to each other about the rounded lateral surface 3 of the semicircular prismatic body 2. This configuration accommodates the resting position of the sacrum. More specifically, the semicircular prismatic body 2 is positioned further up the back to support the user while in a sit-up exercise position, and the semicircular prismatic body 2 is positioned further down the back to support the user while in a pelvis tilt resting position. The first grooved channel 18 traverses from the sacrum-supporting depression 4 to the pelvis-supporting depression 6 in order to accommodate the position of the spine with respect to the lower back arch during the sit-up exercise. Upon the engagement of the neck shaper 12 with that of the body shaper 1, as seen in FIG. 2, the first interlocking arm 14 is terminally connected to the elongated body 13. Similarly, the second interlocking arm 15 is terminally connected to the elongated body 13, opposite the first interlocking arm 14, thereby connecting the elongated body 13 to the semicircular prismatic body 2. Moreover, the elongated body 13 is rotatably mounted to the semicircular prismatic body 2 with the first interlocking arm 14 and the second interlocking arm 15. The arrangement between the neck shaper 12 and the back shaper 1 uplifts the neck and head above the any flat supporting surface, sufficient distant to accomplish the stretching and exercising in the supine position. The elongated body 13 is positioned between the pelvis-supporting depression 6 and the sacrum-supporting depression 4, as to accommodate the positions of the head, neck, and sacrum with respect to each exercise orientation and position. The present invention further comprises a second grooved channel 19 that supports the portion of the spine that traverses through the neck. The second grooved channel 19 traverses across the neck shaper 12. The first grooved channel 18 is centrally aligned with the second grooved channel 19 in order to properly stretch the spine while lowering the back bridge during a neck flexion exercise position.

The engagement of the neck shaper 12, as seen in FIG. 1, FIG. 2, FIG. 3, and FIG. 4 to that of the back shaper 1 allows the head of the user to freely move while in a bridge pose. The head traverses into the pelvis-supporting depression 6 during a neck flexion exercise. The second grooved channel 19 guides a full range of motion of the neck as the head of the user reaches over the elongated body 13.

The preferred embodiment of the present invention not only effectively positions the body parts of the user, but comfortably supports the user. In order to provide comfort to the sacrum of the user, and alignment of the sacrum and spinal column, the sacrum-supporting depression 4 is triangular, as shown in FIG. 1 and FIG. 9. More specifically, the apex 5 of the sacrum-supporting depression 4 is oriented away from the grooved channel. In order to position the arms of the user, the back shaper 1 comprises a couple of forearm-supporting depressions 7. The couple of forearm-supporting depressions 7 comfortably support the forearms, elbows, or hands of the user as the user is stretching or exercising in pelvic tilt. The couple of forearm-supporting depressions 7 are integrated into the semicircular prismatic body 2, defining the proper form for the user. More specifically, the couple of forearm-supporting depressions 7 is positioned between the sacrum-supporting depression 4 and the pelvis-supporting depression 6. Each of the couple of forearm-supporting depressions 7 being positioned equidistant from the sacrum-supporting depression 4. This configuration accommodates the position of the forearms or elbows as the user stretches or exercises. In an alternate embodiment of the present invention, each of the couple of forearm-supporting depressions 7 traverse along an adjacent lateral edge 61 of the rounded lateral surface 3. This arrangement allows the user to easily switch positions and move while remaining pressed against the couple of forearm-supporting depressions 7.

Figure 6:
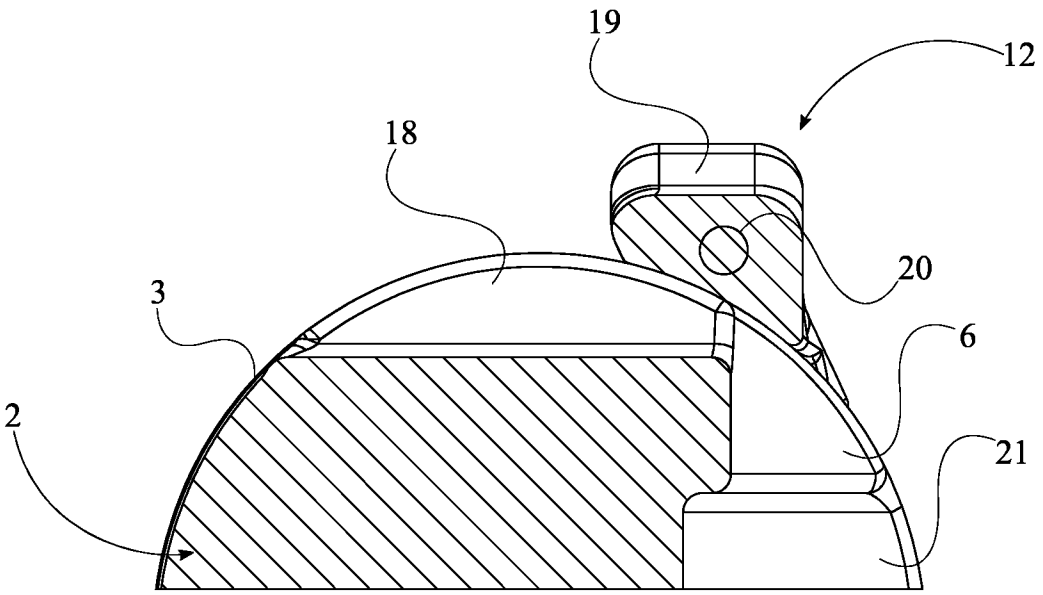
FIG. 6 is a cross-section view of FIG. 4 along line 6-6 of the present invention, wherein the first interlocking arm and the second interlocking arm are in an upright configuration.
Figure 7:
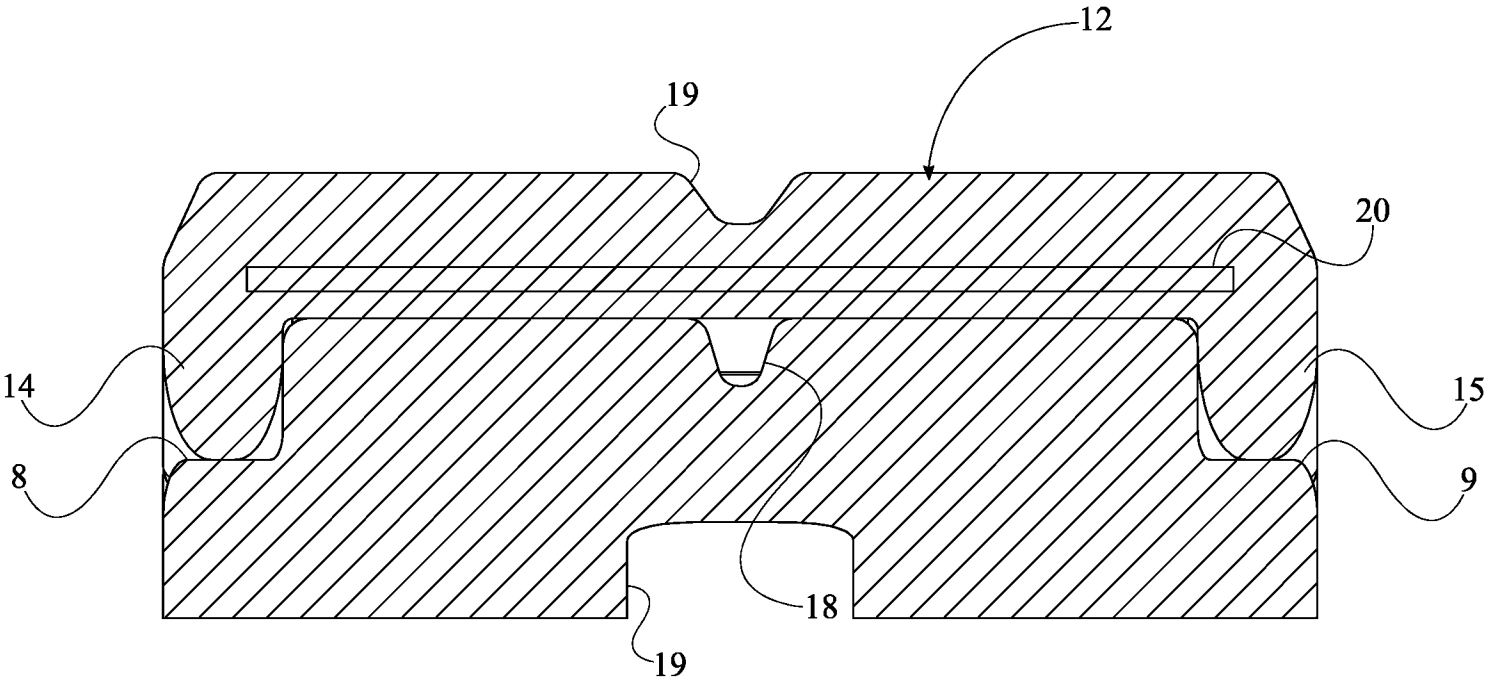
FIG. 7 is a cross-section view of FIG. 4 along line 7-7 of the present invention, wherein the first interlocking arm and the second interlocking arm are in an upright configuration

As the neck of the user is centrally positioned along the elongated body 13, the weight of the neck and head of the user requires more support that the elongated body 13 itself does not provide. A stiffening rod 20, illustrated in FIG. 6 and FIG. 7, preserves the structural integrity of the elongated body 13 even with the applied weight of the neck and the head of the user. The stiffening rod 20 is integrated along the elongated body 13, thereby providing the necessary support to the neck and head of the user, while the elongated body 13 cushions the neck.

The present invention supports and guides the user throughout a variety of movements as the first interlocking arm 14 and the second interlocking arm 15 each comprises a first contact surface 16 and a second contact surface 17, and the back shaper 1 comprises a first arm bed 8 and a second arm bed 9, as seen in FIG. 8 and FIG. 9. The first arm bed 8 and the second arm bed 9 position the first interlocking arm 14 and the second interlocking arm 15 along the back shaper 1. Furthermore, the first arm bed 8 and the second arm bed 9 each comprises a first receiving surface 10 and a second receiving surface 11. The engagement of the first contact surface 16 and the second contact with that of the first receiving surface 10 and the second receiving surface 11, respectively, provides comfort and support to each of the unique body structures of a variety of users while performing specific movements. In order to effectively support and guide the user, the first arm bed 8 and the second arm bed 9 are integrated into and positioned opposite each other across the semicircular prismatic body 2. This arrangement stabilizes the neck shaper 12 on the back shaper 1. More specifically, the pelvis-supporting depression 6 is positioned in between the first arm bed 8 and the second arm bed 9. In order for the position of the elongated body 13 of the neck shaper 12 to remain tangent to the semi-circular prismatic body, the first interlocking arm 14 and the second interlocking arm 15 are oriented perpendicular to the elongated body 13.

Figure 3:
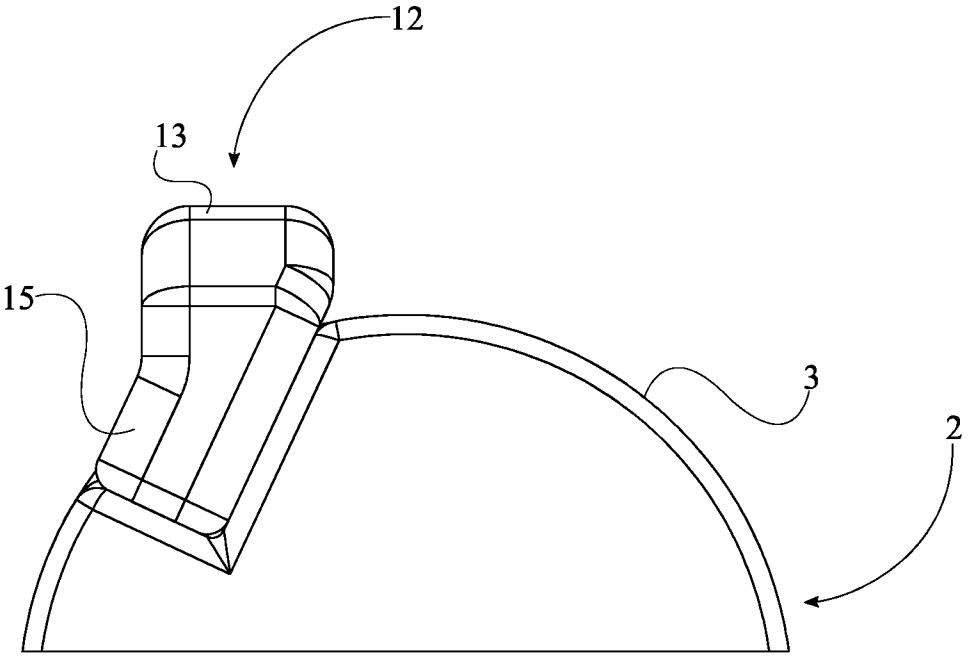
FIG. 3 is a left side view of the present invention, wherein the first interlocking arm and the second interlocking arm are in an upright configuration.

As the user is in a retracted position along the present invention, the first interlocking arm 14 and the second interlocking arm 15 are in an upright configuration, seen in FIG. 3. In order for the first interlocking arm 14 and the second interlocking arm 15 to be in an upright configuration and prevent unwanted rotation of the elongated body 13, the first interlocking arm 14 and the second interlocking arm 15 each comprises a first receiving surface 10 and a second receiving surface 11. Moreover, the first contact surface 16 and the second contact surface 17 are positioned opposite about the arm body and oriented at an acute angle with each other. The acute angle between the first contact surface 16 and the second contact surface 17 prevents the first interlocking arm 14 and the second interlocking arm 15 from switching from the upright configuration to a rested configuration, unless removed and purposefully positioned by the user. The first receiving surface 10 and the second receiving surface 11 accommodate the first contact surface 16 and the second contact surface 17, respectively. While in the upright configuration, the first contact surface 16 of the first interlocking arm 14 is pressed against the first receiving surface 10 of the first arm bed 8. Similarly, the first contact surface 16 of the second interlocking arm 15 is pressed against the first receiving surface 10 the second arm bed 9. This arrangement positions an arch higher along the posterior side of the neck of the user, thereby providing the necessary support and guidance for specific stretches and exercises.

Figure 4:
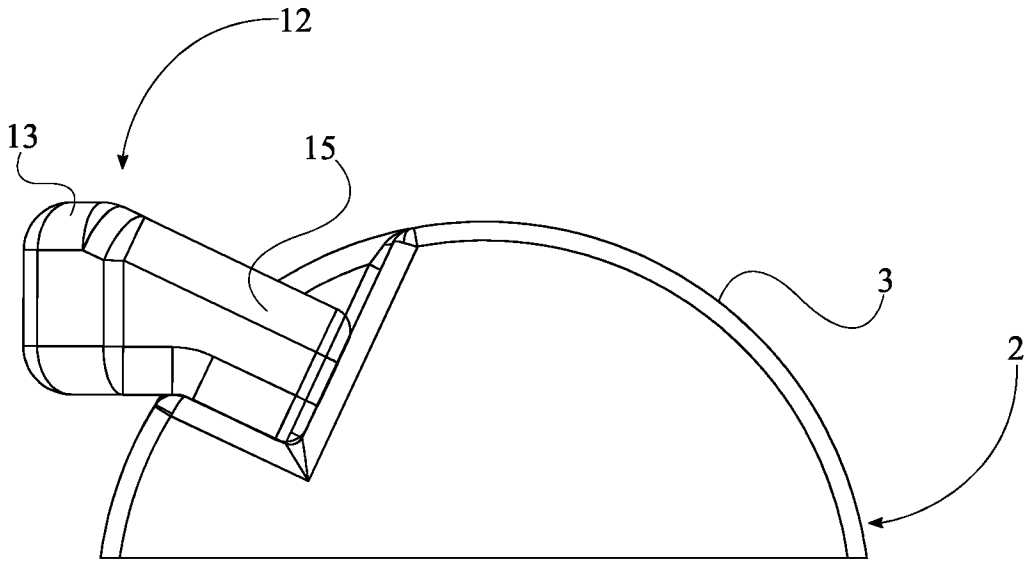
FIG. 4 is a left side view of the present invention, wherein the first interlocking arm and the second interlocking arm are in a rested configuration.
Figure 5:
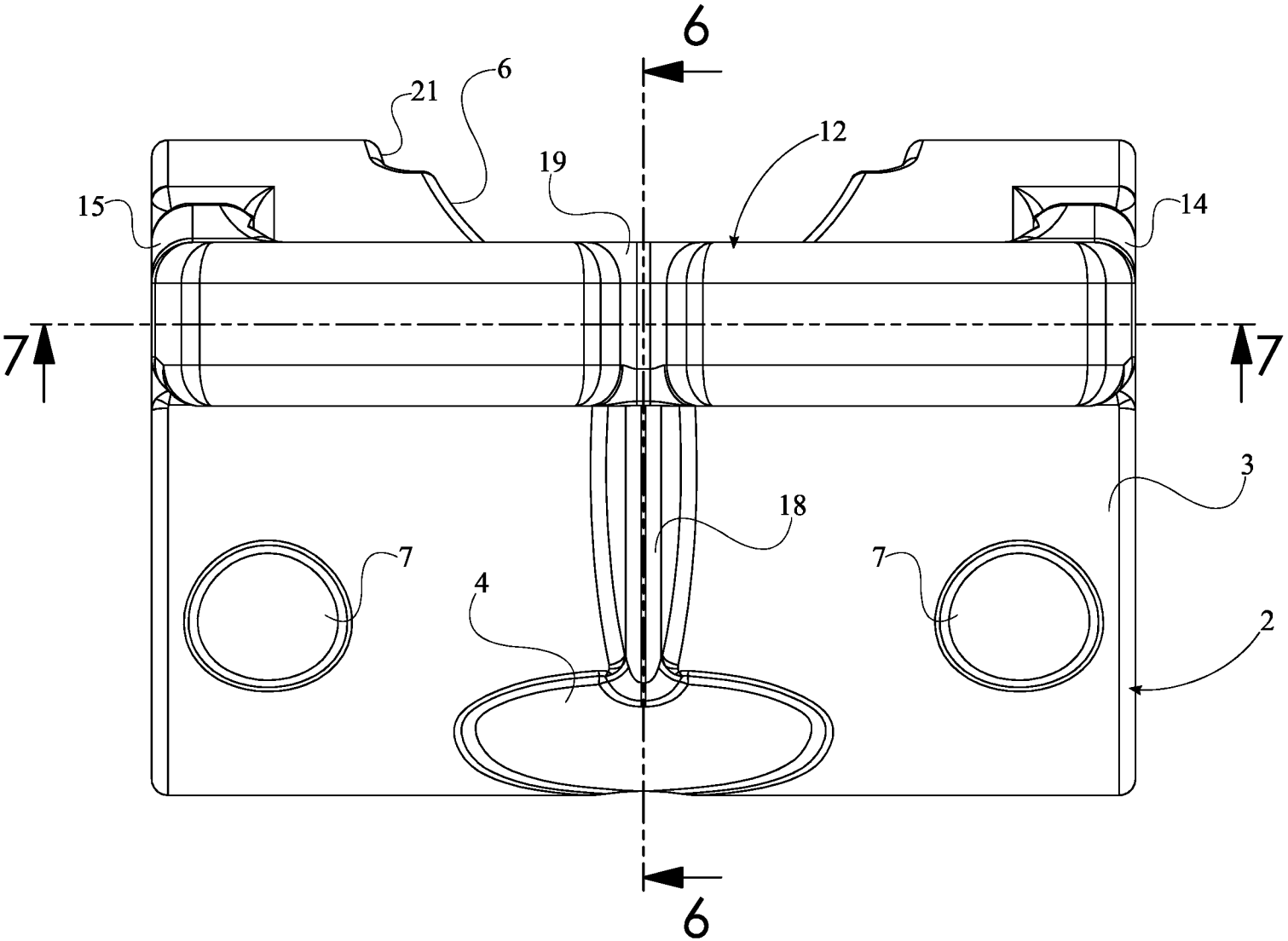
FIG. 5 is a top side view of the present invention, wherein the first interlocking arm and the second interlocking arm are in an upright configuration.

As the user is in an extended position, the first interlocking arm 14 and the second interlocking arm 15 are in a rested configuration, seen in FIG. 4. While in the retracted configuration, the second contact surface 17 of the first interlocking arm 14 is pressed against the second receiving surface 11 of the first arm bed 8. Similarly, the second contact surface 17 of the second pivoting arm 15 is pressed against the second receiving surface 11 of the second arm bed 9. This arrangement positions an arch lower along the back of the user, thereby providing the necessary support and guidance for specific stretches and exercises.

In the preferred embodiment of the present invention, a hand-receiving slot 21, clearly shown in FIG. 2 and FIG. 8, allows a user to easily position and transport the present invention. The hand-receiving slot 21 traverses into the semicircular prismatic body 2 and is positioned adjacent the pelvis-supporting depression 6, opposite the sacrum-supporting depression 4. This arrangement allows the user to easily handle the present invention while preserving the correct form of the user throughout use of the present invention.

The correct form of the user is further preserved while using the present invention as an alternate embodiment of the present invention comprises a seat belt 22, seen in FIG. 10, FIG. 11, FIG. 16, FIG. 17, FIG. 18, and FIG. 19. The seat belt 22 secures the user against the back shaper 1. In order for the seat belt 22 to secure the user against the back shaper 1, the seat belt 22 comprises a first strap 23, a first mounting plate 27, a second strap 24, a second mounting plate 28, and a fastener 29. The first strap 23 wraps around the user with the second strap 24. The first strap 23 is connected with the back shaper 1 with the first mounting plate 27. Similarly, the second strap 24 is connected with the back shaper 1 with the second mounting plate 28. The user is secured between the back shaper 1, the first strap 23, and the second strap 24 with the fastener 29. The seat belt 22 accommodates a variety of users and varying exercises performed by a user as the first mounting plate 27 is terminally mounted onto a first lateral surface 56 of the semicircular prismatic body 2. A second lateral surface 57 of the semicircular prismatic body 2 is positioned opposite the first lateral surface 56 of the semicircular prismatic body 2, across the rounded lateral surface 3. Similarly, the second mounting plate 28 is mounted into the second lateral surface 57 of the semicircular prismatic body 2. This arrangement prevents the user from pressing against the first mounting plate 27 and the second mounting plate 28 while performing any exercise and allows the seat belt 22 to extend over the entire length of the semicircular prismatic body and the width of a variety of users. The first strap 23 is secured with the back shaper 1, as the first end 26 of the first strap 23 is coupled with the first mounting plate 27. A second end 26 of the first strap 23 is positioned opposite the first end 26 of the first strap 23. Similarly, a first end 26 of the second strap 24 is coupled with the second mounting plate 28 in order to secure the secure the second strap 24 with the back shaper 1. A second end 26 of the second strap 24 is positioned opposite the first end 26 of the second strap 24. The user may secure and remove himself or herself from the back shaper as the second end 26 of the first strap 23 is engaged with the second end 26 of the second strap 24 with the fastener 29.

In order for the fastener 29 to easily secure and release a user from the back shaper 1, the fastener 29 comprises a first interlocking portion 30 and a second interlocking portion 31, also seen in FIG. 10, FIG. 11, FIG. 16, FIG. 17, FIG. 18, and FIG. 19. The first interlocking portion 30 is connected to the second end 26 of the first strap 23. The second interlocking portion 31 is connected to the second end 26 of the second strap 24. The first interlocking portion 30 is operatively coupled with the second interlocking portion 31, wherein the first interlocking portion 30 and the second interlocking portion 31 opens and closes the seat belt 22.

The level of intensity of exercise while using the present invention may be increased with a resistance band as the alternate embodiment of the present invention further comprises a reinforcing rod 32, a first mount 35, and a second mount 41, shown in seen in FIG. 10, FIG. 11, FIG. 16, FIG. 17, FIG. 18, and FIG. 19. The reinforcing rod 32 connects the first mount 35 to the second mount 41. The first mount 35 and the second mount 41 allow a resistance band to be attached with and positioned adjacent with the semicircular prismatic body 2. The first mount 35 comprises a first base plate 36 and a first anchor 37. Similarly, the second mount 41 comprises a second plate and a second anchor 43. The first base plate 36 connects the first anchor 37 with the semicircular prismatic body 2, and the second base plate 42 connects the second anchor 43 with the semicircular prismatic body 2. The first anchor 37 and the second anchor 43 allow a resistance band to be secured with present invention. The first mount 35 is securely connected with the semicircular prismatic body 2 as the first base plate 36 is terminally integrated into a first lateral surface 56 of the semicircular prismatic body 2. This arrangement structurally reinforces the back shaper 1. The first anchor 37 is positioned adjacent the first base plate 36, opposite the semicircular prismatic body 2. The first anchor 37 is removably coupled with the semicircular prismatic body 2 with the first base plate 36, thereby allowing varying anchors to be connected with the first base plate 36.

Figure 11:
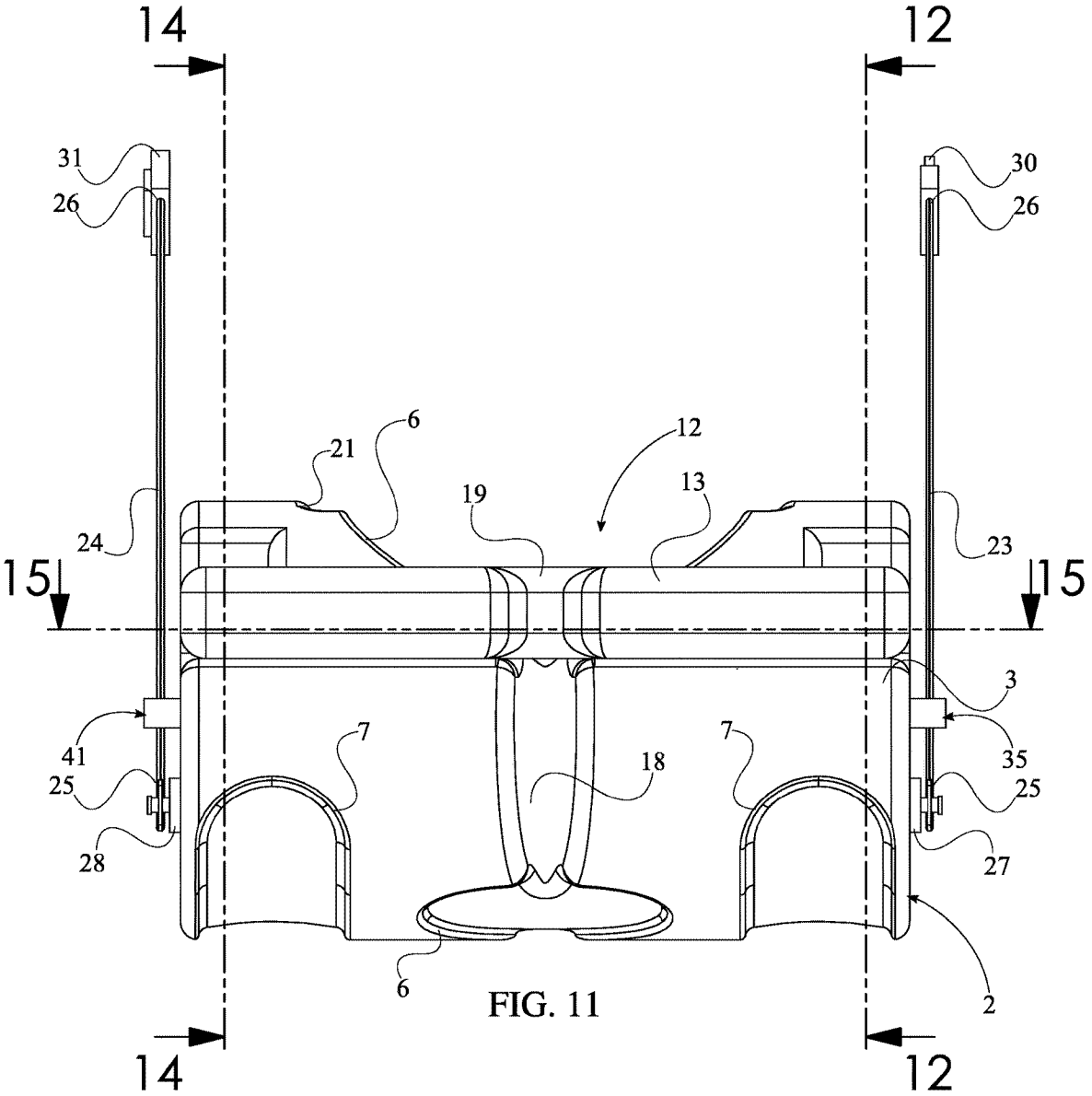
FIG. 11 is a top side view of an alternate embodiment of the present invention, wherein the first interlocking arm and the second interlocking arm are in an upright configuration.
Figure 15:
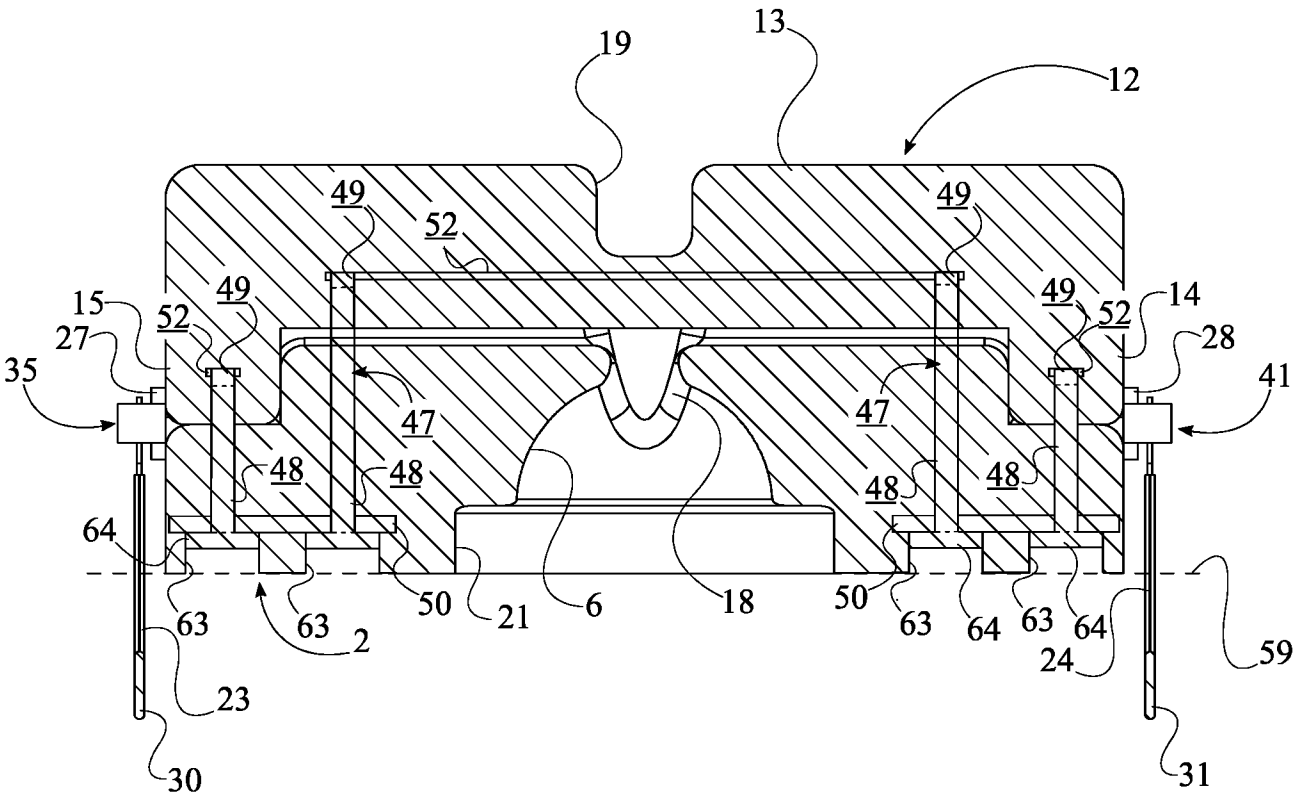
FIG. 15 is a cross-section view of FIG. 11 along line 15-15 of the present invention, wherein the first interlocking arm and the second interlocking arm are in an upright configuration.

The second mount 41 is positioned opposite the first mount 35 as a second lateral surface 57 of the semicircular prismatic body 2 is positioned opposite the first lateral surface 56 of the semicircular prismatic body 2, across the rounded lateral surface 3, seen in FIG. 11 and FIG. 15. The second mount 41 is secured with the semicircular prismatic body 2 as the second base is terminally integrated into the second lateral surface 57 of the semicircular prismatic body 2. The second anchor 43 is positioned adjacent the second base plate 42, opposite the semicircular prismatic body 2. The second anchor 43 is removably coupled with the semicircular prismatic body 2 with the second base plate 42, allowing the second anchor 43 to be interchangeable. The reinforcing rod 32 laterally traverses within the semicircular prismatic body. Consequently, the first mount 35 and the second mount 41 remain attached with the semicircular prismatic body as the user performs a variety of exercises with a resistance band. Moreover, the first mount 35 is connected to the second mount 41 with the reinforcing rod 32.

Figure 12:
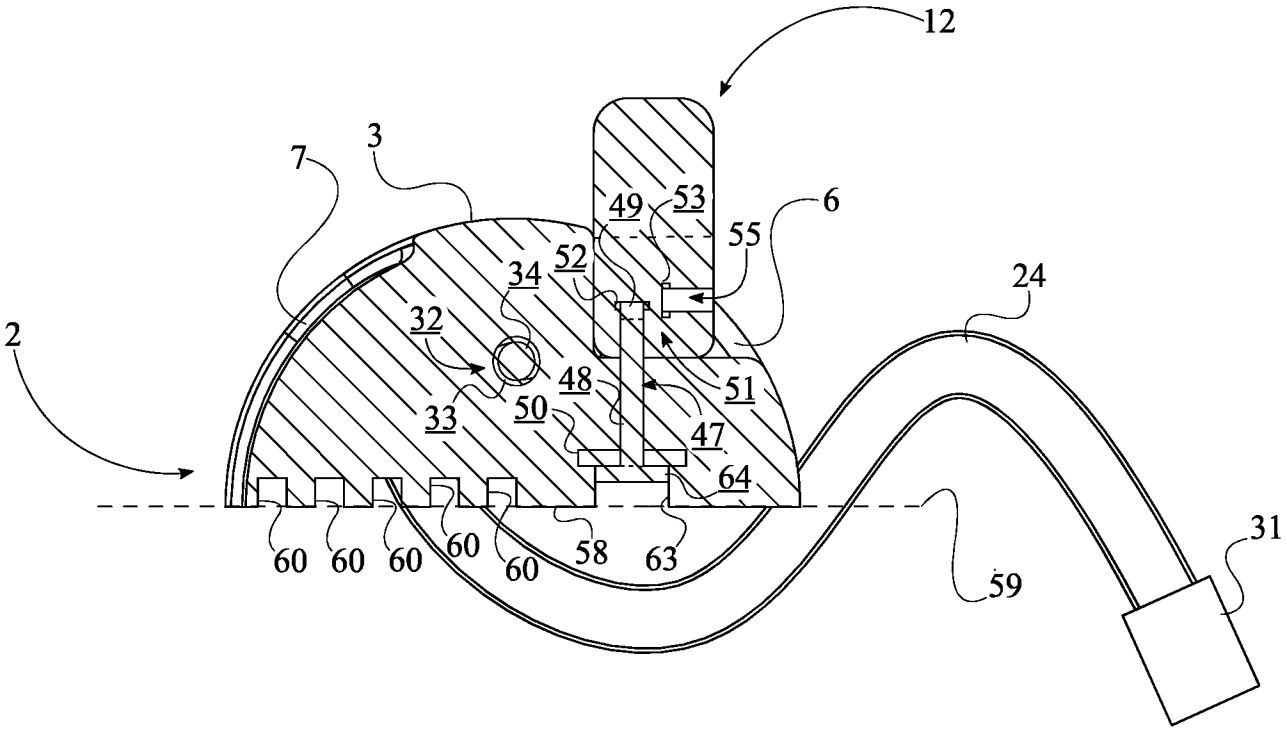
FIG. 12 is a cross-section view of FIG. 11 along line 12-12 of the present invention, wherein the first interlocking arm and the second interlocking arm are in an upright configuration.
Figure 13:
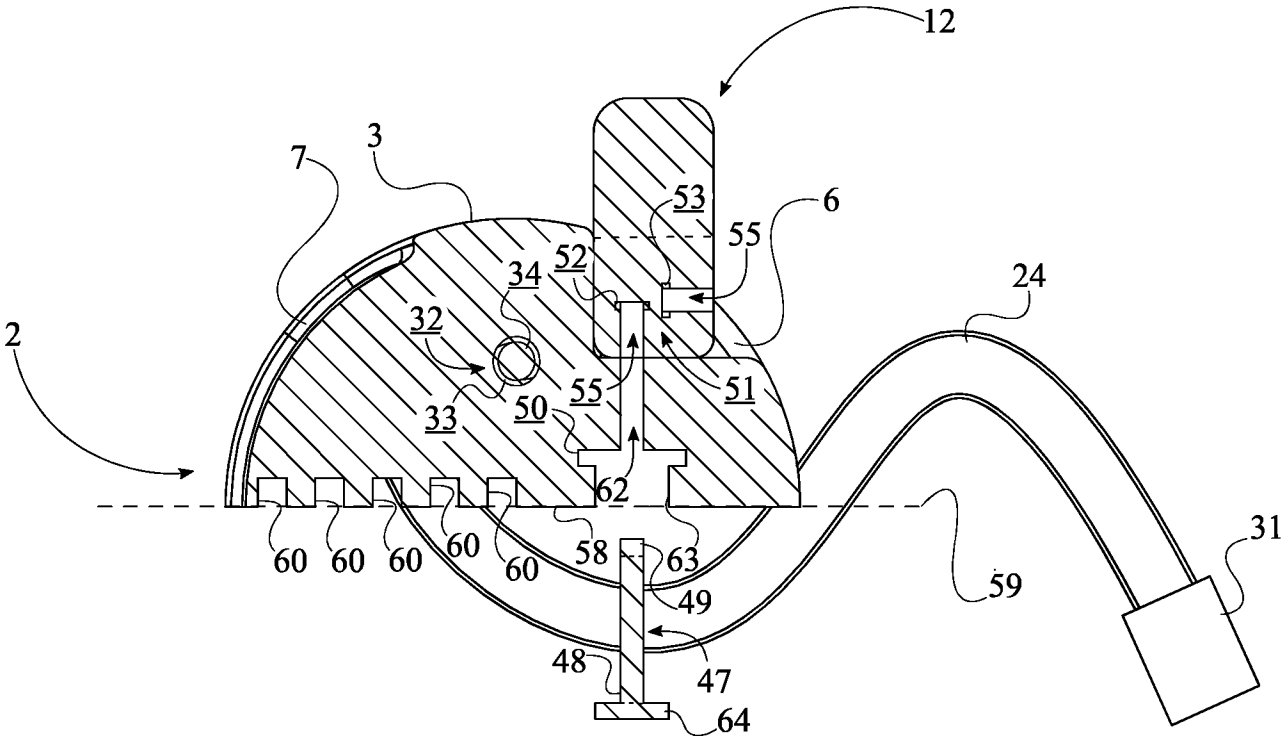
FIG. 13 is a cross-section view of FIG. 11 along line 12-12 of the present invention, wherein at least one post is separated from within at least one securing slot and at least one post-receiving slot.
Figure 14:
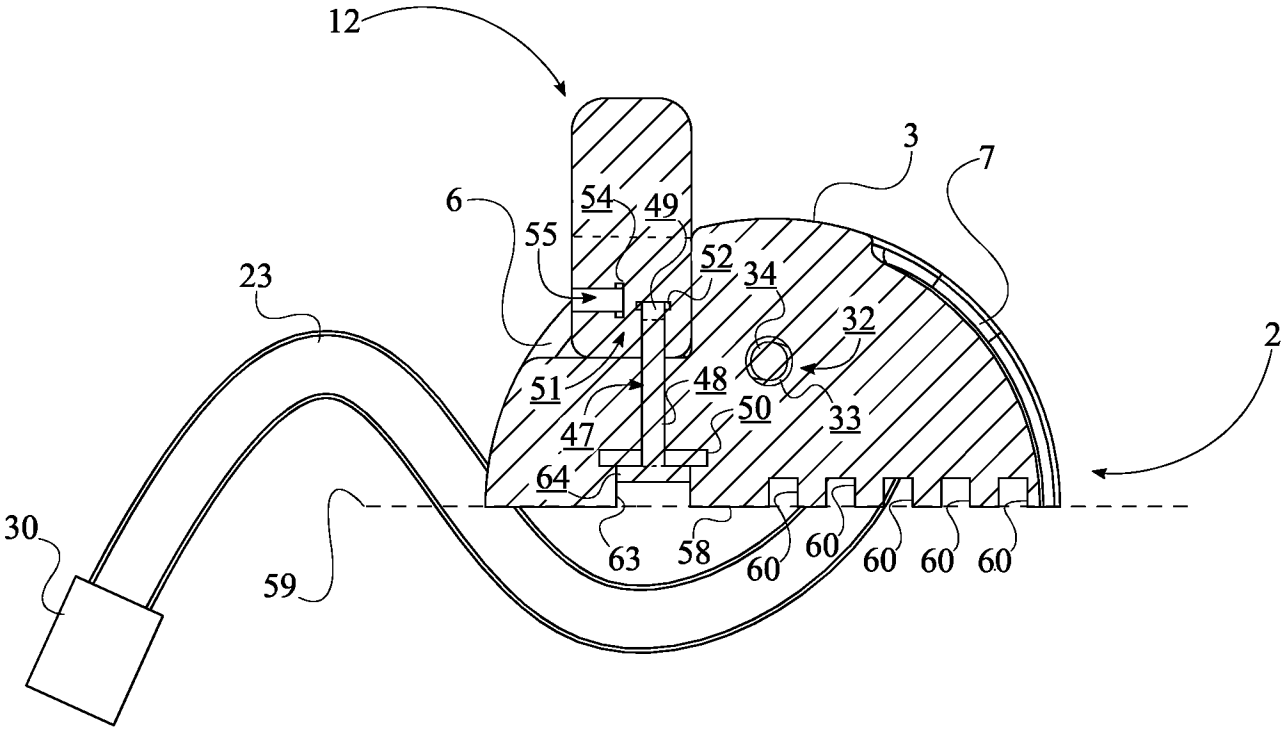
FIG. 14 is a cross-section view of FIG. 11 along line 14-14 of the present invention, wherein the first interlocking arm and the second interlocking arm are in an upright configuration.

The reinforcing rod 32 preferably comprise a plurality of threads 33 and a shaft 34 in order to preserve the structural integrity of the semicircular prismatic body 2, seen in FIG. 12, FIG. 13, and FIG. 14. The stress of the reinforcing rod 32 within the semicircular prismatic body from the resistance bands against the first mount 35 and the second mount 41 is diffused across the reinforcing rod 32 as plurality of threads 33 is radially distributed across the shaft 34. The first base is terminally positioned adjacent the shaft 34. Similarly, the second base is positioned adjacent the shaft 34, opposite the first base.

Figure 16:
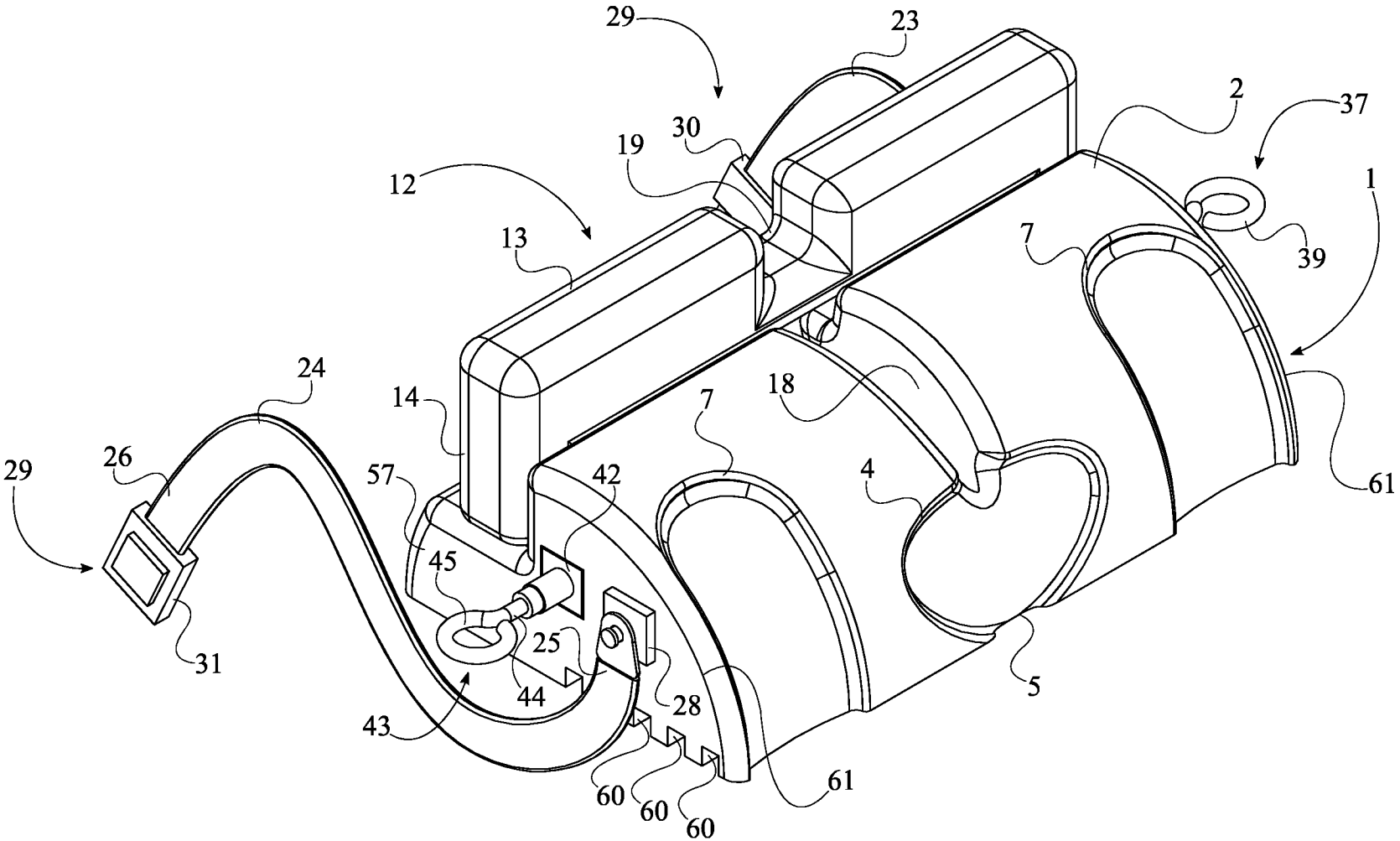
FIG. 16 is a left perspective view of an alternate embodiment of the present invention, wherein a first anchor and a second anchor comprise a first eyelet and a second eyelet, respectively.
Figure 17:
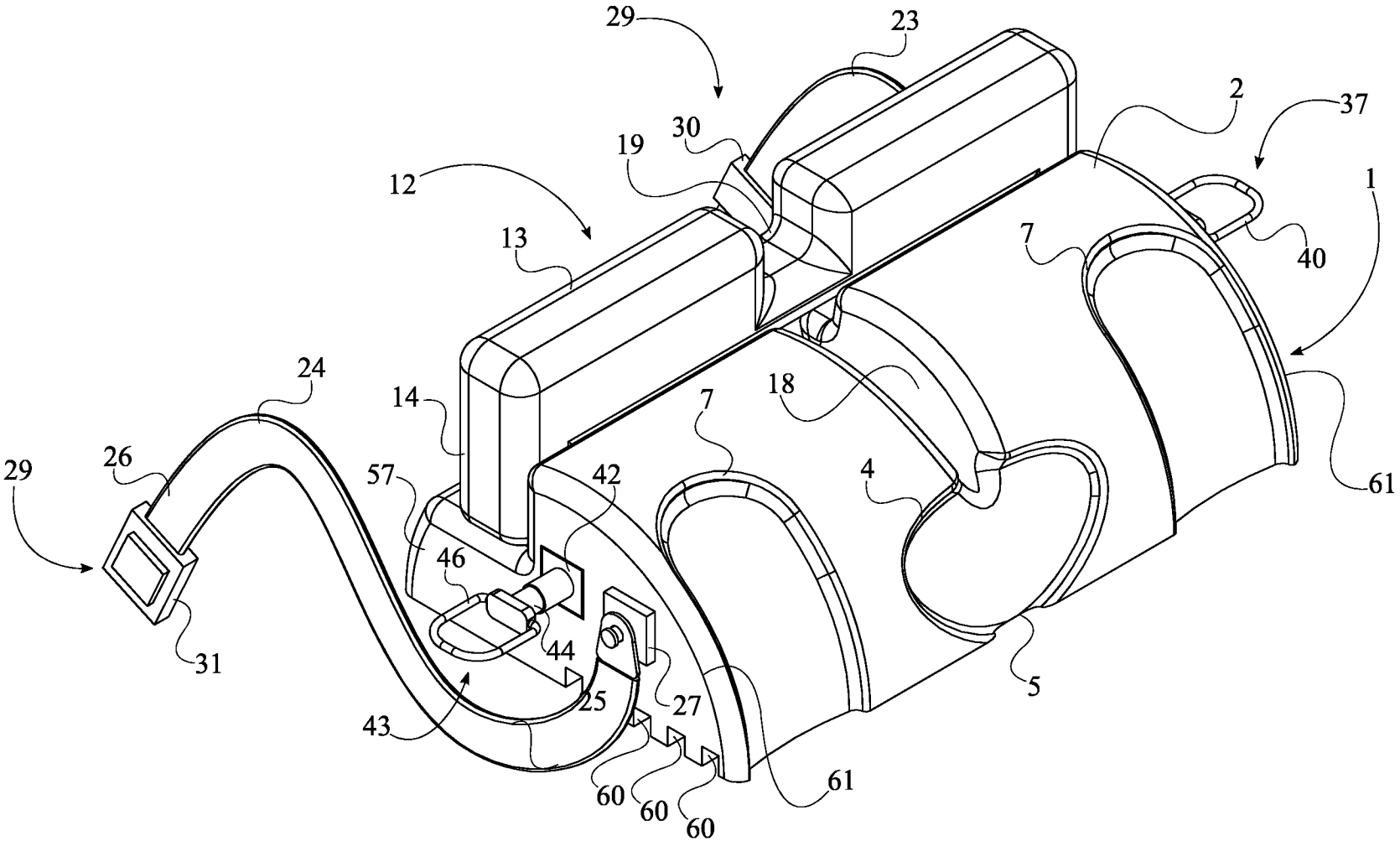
FIG. 17 is a left perspective view of an alternate embodiment of the present invention, wherein the first anchor and the second anchor comprise a first bail and a second bail, respectively.
Figure 18:
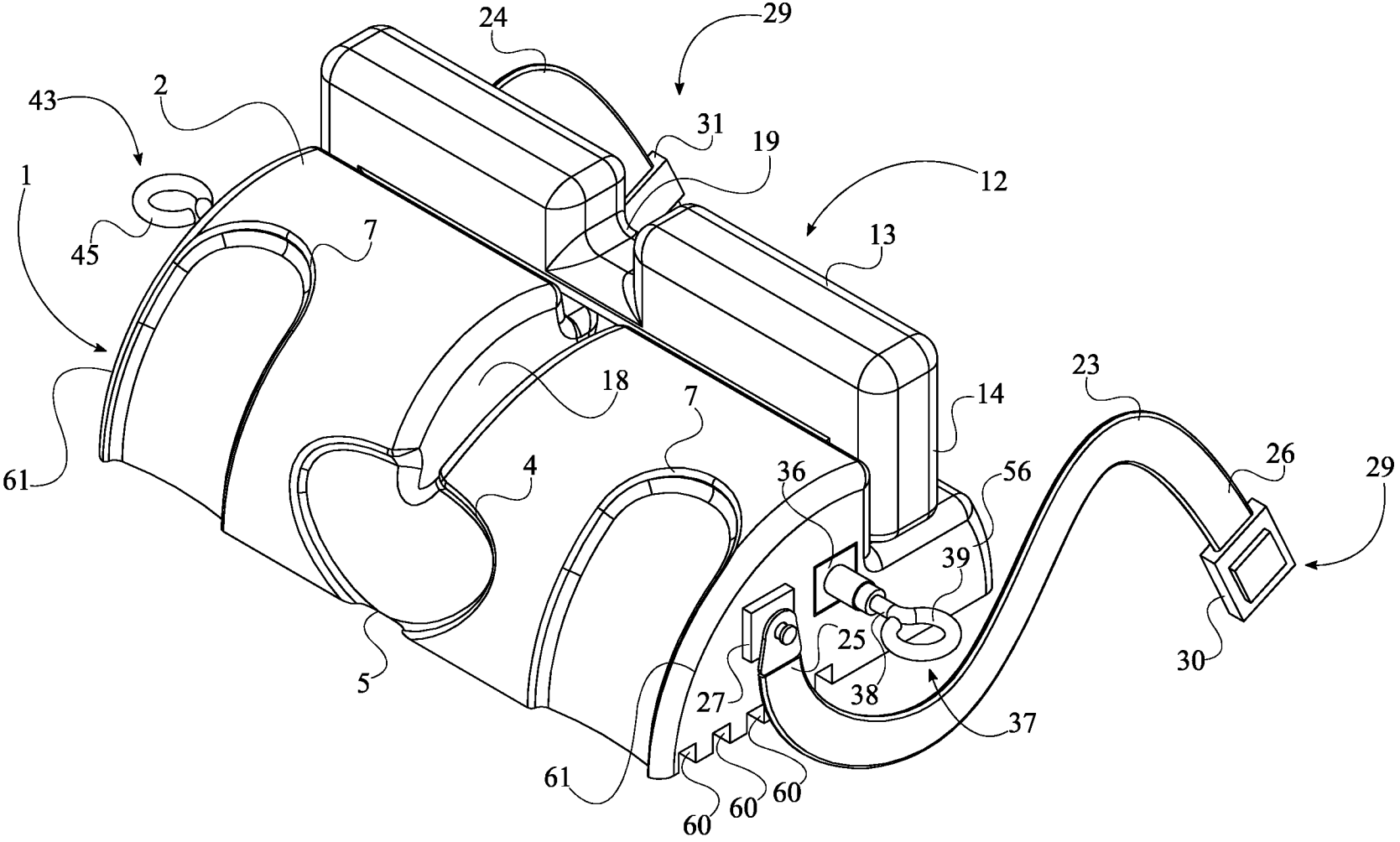
FIG. 18 is a right perspective view of an alternate embodiment of the present invention, wherein the first anchor and the second anchor comprise the first eyelet and the second eyelet, respectively.

In a first alternate embodiment of the present invention, the first anchor 37 comprises a first shaft 38 and a first eyelet 39, and the second anchor 43 comprises a second shaft 44 and a second eyelet 46, shown in FIG. 16 and FIG. 18. The first shaft 38 and the second shaft 44 extend the first eyelet 39 and the second eyelet 46 from the semicircular prismatic body 2, respectively. The first eyelet 39 and the second eyelet 46 allow a resistance band or a variety of other exercise accessories to be connected with the present invention. In this first alternate embodiment, the first base plate 36 is terminally positioned adjacent the first shaft 38, and the first eyelet 39 is fixed to the first shaft 38, positioned opposite the first base plate 36. The first anchor 37 is interchangeable and securely attached with the first base plate 36 as the first shaft 38 is threadedly engaged with the first base plate 36. Similarly, the second base plate 42 is terminally positioned adjacent the second shaft 44, and the second eyelet 46 is fixed to the second shaft 44, positioned opposite the second base plate 42. The second anchor 43 is interchangeable and securely attached with the second base plate 42 as the second shaft 44 is threadedly engaged with the second base plate 42.

Figure 19:
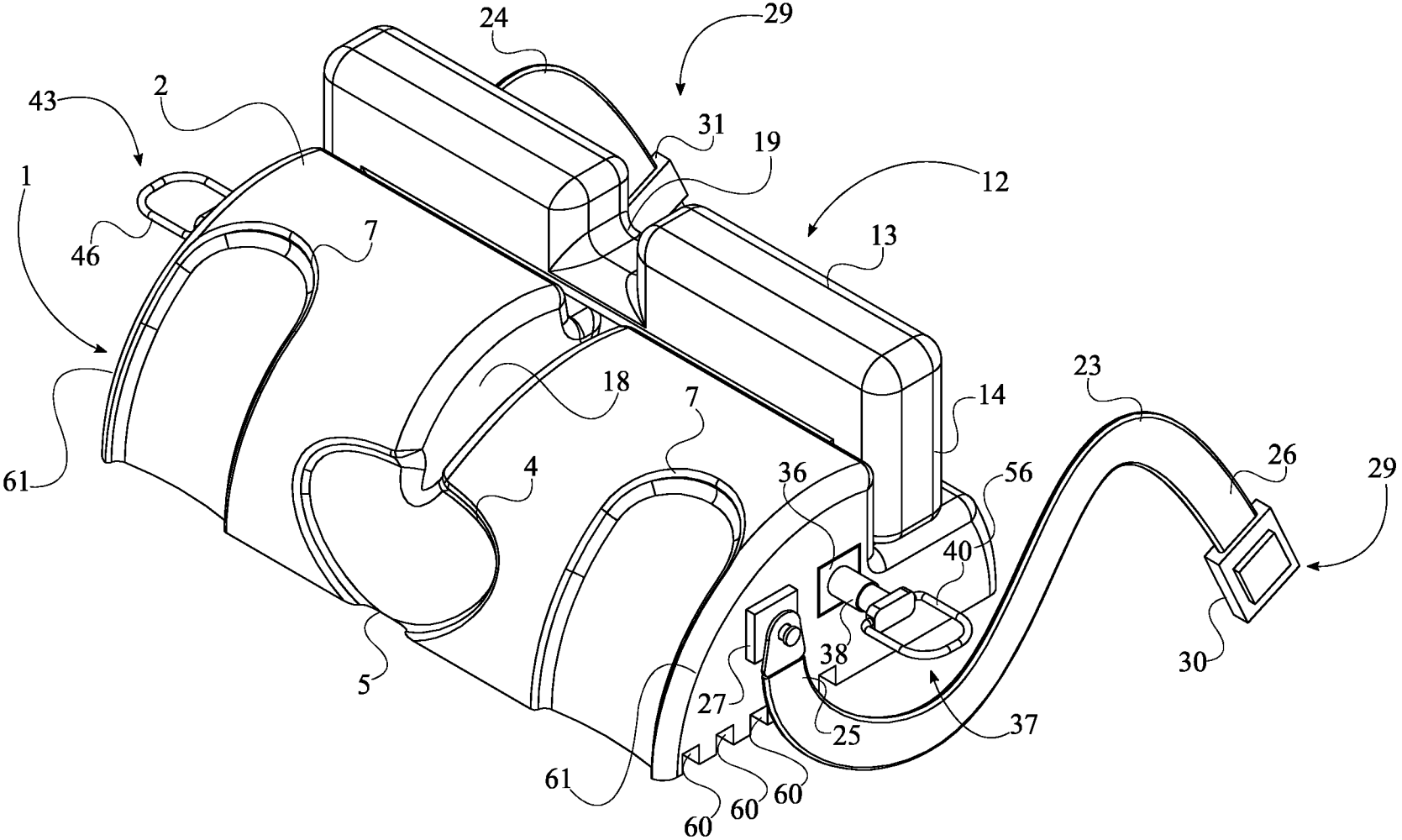
FIG. 19 is a right perspective view of an alternate embodiment of the present invention, wherein the first anchor and the second anchor comprise the first bail and the second bail, respectively.

In a second embodiment of the present invention, the first anchor 37 comprises a first shaft 38, a first body, and a first bail 40, seen in FIG. 19. Similarly, the second anchor 43 comprises a second shaft 44, a second body, and a second bail 46, seen in FIG. 17. The first shaft 38 and the second shaft 44 extend and offset the first body and the second body with the semicircular prismatic body 2, respectively. The first body and the second body allow the first bail 40 and the second bail 46 to pivot about the first shaft 38 and the second shaft 44, respectively. In alternate embodiments of the present invention, the first body and the second body may also allow the first bail 40 and the second bail 46 to rotate as well. Similar to the first embodiment of the present invention, the first base plate 36 is terminally positioned adjacent the first shaft 38. The first body is fixed to the first shaft 38, positioned opposite the first base plate 36, and the first bail 40 is hingedly connected to the first body, positioned opposite the first body. This arrangement allows the first anchor 37 to better accommodate the natural movement and motions of the user while performing a variety of exercises. The first anchor 37 of the second embodiment of the present invention is also interchangeable as the first shaft 38 is threadedly engaged with the first base plate 36. Similarly, the second base plate 42 is terminally positioned adjacent the second shaft 44. The second body is fixed to the second shaft 44, positioned opposite the second base plate 42, and the second bail 46 is hingedly connected to the body, positioned opposite the second body. This arrangement allows the second anchor 43 to move in unison with the first anchor 37, and allows the second anchor 43 to better accommodate the natural movement and motions of the user while performing a variety of exercises. The second shaft 44 is threadedly engaged with the second base plate 42.

In order to secure the position of the neck shaper 12 with that of the back shaper 1, an alternate embodiment of the present invention comprises at least one post 47, at least one stabilizing plate 50, at least one stiffening plate 51, at least one securing slot 55, and at least one post-receiving slot 62, seen in FIG. 12, FIG. 13, FIG. 14, and FIG. 15. Furthermore, the semicircular prismatic body comprises a planar base surface 58 that presses against the ground or similar surface. The at least one post 47 connects the back shaper 1 with the neck shaper 12 with the at least one stabilizing plate 50 and the at least one stiffening plate 51 through the at least one securing slot 55. The planar base surface 58 is positioned opposite the rounded lateral surface across the semicircular prismatic body 2. The at least one stabilizing plate 50 is integrated across the semicircular prismatic body, positioned adjacent the planar base surface 58. More specifically, the at least one stabilizing plate 50 is oriented parallel with a transverse plane 59 of the semicircular prismatic body 2. The at least one stiffening plate 51 is integrated across the neck shaper 12. In order for the back shaper 1 to accommodate the at least one post 47, the at least one post-receiving slot 62 traverses into the planar base surface 58, through the at least one stabilizing plate 50, and through the semicircular prismatic body 2. Similarly, in order for the neck shaper 12 to accommodate the at least one post 47, the at least one securing slot 55 traverses into the neck shaper 12 and into the at least one stiffening plate 51. The at least one securing slot 55 is oriented parallel with the at least one post-receiving slot 62. Moreover, at least one securing slot 55 is coincident with and positioned adjacent with the at least one post-receiving slot 62, thereby providing a continuous path through the back shaper 1 and into the neck shaper 12. In order to secure the orientation and connection of the neck shaper 12 with the back shaper 1, the at least one post 47 is slidably engaged with the at least one post-receiving slot 62 and the at least one securing slot 55.

The neck shaper 12 is stabilized with the back shaper 1 as the at least one stiffening plate 51 preferably comprises a first stiffening plate 52, a second stiffening plate 53, and a third stiffening plate 54, shown in FIG. 12, FIG. 13, and FIG. 14. The first stiffening plate 52 is integrated across the neck shaper 12. The first interlocking arm and the second interlocking arm are secured within the first arm bed 8 and the second arm bed 9 as the second stiffening plate 53 is integrated within the first interlocking arm and the third stiffening plate 54 is integrated within the second interlocking arm. Moreover, the first stiffening plate 52 is oriented parallel with the at least one stabilizing plate 50, securing the neck shaper 12 in the upright configuration. Consequently, the neck shaper 12 is secured in the rested configuration as the first stiffening plate 52 is oriented perpendicular with both the second stiffening plate 53 and the third stiffening plate 54.

The present invention further comprises at least one bed 63, shown in FIG. 12, FIG. 13, FIG. 14, and FIG. 15. The at least one bed 63 prevents the at least one post 47 from extending past the at least one securing slot 62 and tearing the neck shaper 12. The at least one post 47 preferably engages with the at least one securing slot 55 as the at least one post 47 comprises a shaft 48, a head 49, and a stopper plate 64. The shaft 48 connects the head 49 with the stopper plate 64. The head latches into the at least securing slot 62 and through the at least one stiffening plate 51. The stopper plate 64 presses against the at least one bed 63 and stops the shaft from over extending within the at least one securing slot 62. The at least one bed 63 is integrated into the semicircular prismatic body 2. More specifically, the at least one bed 63 traverses from the planar base surface 58 to the at least one post-receiving slot 62. The stopper plate 64 is terminally fixed with the shaft 48. In alternate embodiments of the present invention the stopper plate 64 is threadedly engaged with the shaft 48 so the connection between of the neck shaper 12 with the back shaper 1 may be tightened and loosened with the stopper plate 64. The head 49 is fixed with the shaft 48, positioned opposite the stopper plate 64. This arrangement allows the shaft 48 to be positioned within both the at least one securing slot 55 and the at least one post-receiving slot 62. It is understood that the head freely and continuously traverses through the at least one securing slot 55 and the at least one post-receiving slot 62 while preserving the integrity of the back shaper 1 and the neck shaper 12. The head 49 is operatively coupled with the at least one stiffening plate 51, wherein the head 49 connects the neck shaper 12 with the back shaper 1 within the at least one securing slot 55, and the stopper plate 64 presses against the at least one stabilizing plate 50. This allows the neck shaper 12 to be removably attached with the back shaper 1. This arrangement also allows the head 49 to slip past the at least one stiffening plate 51, requiring significant force by the user to remove the neck shaper 12 from the back shaper 1.

In alternate embodiments of the present invention, a tee nut is positioned within the at least one securing slot 55 and integrated through the at least one stiffening plate 51. The at least one post 47 further comprises a plurality of threads that is laterally positioned along the head 49. The plurality of threads engages with a threaded slot of the tee nut and secures the at least one post 47 within the at least one securing slot 55, and consequently the at least one post 47 with the neck shaper 12.

Further embodiments of the present invention may comprise a release button and a couple of notches. Moreover, the at least one post 47 further comprises a couple of spring-loaded tabs. The couple of spring-loaded tabs are laterally integrated into the head 49. The release button is integrated into the stopper plate 64, positioned opposite the shaft 48. The couple of notches traverse from the at least one securing slot 55 and into the at least one stiffening plate 51 in order for the couple of spring-loaded tabs to latch with the at least one stiffening plate 51. The couple of spring-loaded tabs is operatively coupled with the at least one securing slot 55 with the release button, wherein the couple of spring-loaded tabs press into the couple of notches and secure the at least one post 47 into the at least one securing slot 55.

In an alternate embodiment of the present invention, the back shaper comprises a plurality of sipes 60 thereby securing the position of the back shaper 1 across the ground or similar surface, seen in FIG. 10, FIG. 12, FIG. 13, FIG. 14, FIG. 16, FIG. 17, FIG. 18, and FIG. 19. The planar base surface 58 of the semicircular prismatic body 2 directly presses against the ground or similar surface as the planar base surface 58 is positioned opposite the rounded lateral surface, across the semicircular prismatic body. Consequently, the plurality of sipes 60 is integrated into the planar base surface 58. Moreover, the plurality of sipes 60 laterally traverses along and across the planar base surface 58 in order to counteract the force of the weight and the movements of the user while performing a variety of exercises.

Although the invention has been explained in relation to its preferred embodiment, it is to be understood that many other possible modifications and variations can be made without departing from the spirit and scope of the invention as hereinafter claimed.

What is claimed is:

1. A cushioning posterior fulcrum back shaper comprises:

a back shaper;

a neck shaper;

a first grooved channel;

the back shaper comprises a semicircular prismatic body, a sacrum-supporting depression, and a pelvis-supporting depression;

the neck shaper comprises an elongated body, a first interlocking arm, and a second interlocking arm;

the sacrum-supporting depression and the pelvis-supporting depression being integrated into a rounded lateral surface of the semicircular prismatic body;

the sacrum-supporting depression and the pelvis-supporting depression being positioned opposite to each other about the rounded lateral surface of the semicircular prismatic body;

the first interlocking arm being terminally connected to the elongated body;

the second interlocking arm being terminally connected to the elongated body, opposite the first interlocking arm;

the elongated body being rotatably mounted to the semicircular prismatic body with the first interlocking arm and the second interlocking arm;

the elongated body being positioned between the pelvis-supporting depression and the sacrum-supporting depression; and, the first grooved channel traversing from the sacrum-supporting depression to the pelvis-supporting depression.

2. The cushioning posterior fulcrum back shaper as claimed in claim 1 comprises:

a second grooved channel;

the second grooved channel traversing across the neck shaper; and, the first grooved channel being centrally aligned with the second grooved channel.

3. The cushioning posterior fulcrum back shaper as claimed in claim 1 comprises:

the sacrum-supporting depression being triangular; and, an apex of the sacrum-supporting depression being oriented away from the first grooved channel.

4. The cushioning posterior fulcrum back shaper as claimed in claim 1 comprises:

the back shaper comprises a couple of forearm-supporting depressions;

the couple of forearm-supporting depressions being integrated into the semicircular prismatic body;

the couple of forearm-supporting depressions being positioned opposite to each other along the semicircular prismatic body;

the couple of forearm-supporting depressions being positioned between the sacrum-supporting depression and the pelvis-supporting depression; and, each of the couple of forearm-supporting depressions being positioned equidistant from the sacrum-supporting depression.

5. The cushioning posterior fulcrum back shaper as claimed in claim 4 comprises:

each of the couple of forearm-supporting depressions traversing along an adjacent lateral edge of the rounded lateral surface;

6. The cushioning posterior fulcrum back shaper as claimed in claim 1 comprises:

a stiffening rod; and, the stiffening rod being integrated along the elongated body.

7. The cushioning posterior fulcrum back shaper as claimed in claim 1 comprises:

the first interlocking arm and the second interlocking arm each comprises a first contact surface and a second contact surface;

the back shaper comprises first arm bed and a second arm bed;

the first arm bed and the second arm bed each comprises a first receiving surface and a second receiving surface;

the first arm bed and the second arm bed being integrated into the semicircular prismatic body;

the first arm bed and the second arm bed being positioned opposite each other across the semicircular prismatic body;

the pelvis-supporting depression being positioned between the first arm bed and the second arm bed; and, the first interlocking arm and the second interlocking arm being oriented perpendicular to the elongated body.

8. The cushioning posterior fulcrum back shaper as claimed in claim 7 comprises:

wherein the first interlocking arm and the second interlocking arm are in an upright configuration;

the first interlocking arm and the second interlocking arm comprises an arm body, a first contact surface, and a second contact surface;

the first contact surface and the second contact surface being positioned opposite about the arm body;

the first receiving surface and the second receiving surface being oriented at an acute angle with each other;

the first contact surface of the first interlocking arm being pressed against the first receiving surface of the first arm bed;

the first contact surface of the second interlocking arm being pressed against the first receiving surface of the second arm bed;

the second contact surface of the first interlocking arm being pressed against the second receiving surface of the first arm bed; and, the second contact surf ace of the second interlocking arm being pressed against the second receiving surface of the second arm bed.

9. The cushioning posterior fulcrum back shaper as claimed in claim 7 comprises:

wherein the first interlocking arm and the second interlocking arm are in a rested configuration;

the first interlocking arm and the second interlocking arm comprises an arm body, a first contact surface, and a second contact surface;

the first contact surface and the second contact surface being positioned opposite about the arm body;

the first receiving surface and the second receiving surface being oriented at an acute angle with each other;

the second contact surface of the first interlocking arm being pressed against the second receiving surface of the first arm bed; and, the second contact surf ace of the second interlocking arm being pressed against the second receiving surface of the second arm bed.

10. The cushioning posterior fulcrum back shaper as claimed in claim 1 comprises:

a hand-receiving slot;

the hand-receiving slot traversing into the semicircular prismatic body; and, the hand-receiving slot being positioned adjacent the pelvis-supporting depression, opposite the sacrum-supporting depression.

11. The cushioning posterior fulcrum back shaper as claimed in claim 1 comprises:

a seat belt;

the seat belt comprises a first strap, first mounting plate, a second strap, a second mounting plate, and a fastener;

the first mounting plate being terminally mounted into a first lateral surface of the semicircular prismatic body;

a second lateral surface of the semicircular prismatic body being positioned opposite the first lateral surface of semicircular prismatic body, across the rounded lateral surface;

the second mounting plate being mounted into the second lateral surface of the semicircular prismatic body;

a first end of the first strap being coupled with the first mounting plate;

a second end of the first strap being positioned opposite the first end of the first strap;

a first end of the second strap being coupled with the second mounting plate;

a second end of the second strap being positioned opposite the first end of the second strap; and, the second end of the first strap being engaged with the second end of the second strap with the fastener.

12. The cushioning posterior fulcrum back shaper as claimed in claim 11 comprises:

the fastener comprises a first interlocking portion and a second interlocking portion;

the first interlocking portion being connected to the second end of the first strap;

the second interlocking portion being connected to the second end of the second strap; and, the first interlocking portion being operatively coupled with the second interlocking portion, wherein the first interlocking portion and the second interlocking portion opens and closes the seat belt.

13. The cushioning posterior fulcrum back shaper as claimed in claim 1 comprises:

a reinforcing rod;

a first mount;

a second mount;

the first mount comprises a first base plate and a first anchor;

the second mount comprises a second base plate and a second anchor;

the first base plate being terminally integrated into a first lateral surface of the semicircular prismatic body;

the first anchor being positioned adjacent the first base plate, opposite the semicircular prismatic body;

the first anchor being removably coupled with the semicircular prismatic body with the first base plate;

a second lateral surface of the semicircular prismatic body being positioned opposite the first lateral surface of semicircular prismatic body, across the rounded lateral surface;

the second base plate being terminally integrated into the second lateral surface of the semicircular prismatic body;

the second anchor being positioned adjacent the second base plate, opposite the semicircular prismatic body;

the second anchor being removably coupled with the semicircular prismatic body with the second base plate;

the reinforcing rod laterally traversing within the semicircular prismatic body; and, the first mount being connected to the second mount with the reinforcing rod.

14. The cushioning posterior fulcrum back shaper as claimed in claim 13 comprises:

the reinforcing rod comprises a plurality of threads and a shaft;

the plurality of threads being radially distributed across the shaft;

the first base plate being terminally positioned adjacent the shaft; and, the second base being positioned adjacent the shaft, opposite the first base.

15. The cushioning posterior fulcrum back shaper as claimed in claim 13 comprises:

the first anchor comprises a first shaft and a first eyelet;

the second anchor comprises a second shaft and a second eyelet;

the first base plate being terminally positioned adjacent the first shaft;

the first eyelet being fixed to the first shaft, positioned opposite the first base plate;

the first shaft being threadedly engaged with the first base plate;

the second base plate being terminally positioned adjacent the second shaft;

the second eyelet being fixed to the second shaft, positioned opposite the second base plate; and, the second shaft being threadedly engaged with the second base plate.

16. The cushioning posterior fulcrum back shaper as claimed in claim 13 comprises:

the first anchor comprises a first shaft, a first body, and a first bail;

the second anchor comprises a second shaft, a second body, and a second bail;

the first base plate being terminally positioned adjacent the first shaft;

the first body being fixed to the first shaft, positioned opposite the first base plate;

the first bail being hingedly connected to the body, positioned opposite the first body;

the first shaft being threadedly engaged with the first base plate;

the second base plate being terminally positioned adjacent the second shaft;

the second body being fixed to the second shaft, positioned opposite the second base plate;

the second bail being hingedly connected to the body, positioned opposite the second body; and, the second shaft being threadedly engaged with the second base plate.

17. The cushioning posterior fulcrum back shaper as claimed in claim 1 comprises:

at least one post;

at least one stabilizing plate;

at least one stiffening plate;

at least one securing slot;

at least one post-receiving slot;

the semicircular prismatic body comprises a planar base surface;

the planar base surface being positioned opposite the rounded lateral surface across the semicircular prismatic body;

the at least one stabilizing plate being integrated across the semicircular prismatic body, positioned adjacent the planar base surface;

the at least one stabilizing plate being oriented parallel with a transverse plane of the semicircular prismatic body;

the at least one stiffening plate being integrated across neck shaper;

the at least one post-receiving slot traversing into the planar base surface, through the at least one stabilizing plate, and through the semicircular prismatic body;

the at least one securing slot traversing into the neck shaper and into the at least one stiffening plate;

the at least one securing slot being oriented parallel with the at least one post-receiving slot;

the at least one securing slot being coincident with and positioned adjacent with the at least one post-receiving slot; and, the at least one post being slidably engaged with the at least one post-receiving slot and the at least one securing slot.

18. The cushioning posterior fulcrum back shaper as claimed in claim 17 comprises:

the at least one stiffening plate comprises a first stiffening plate, a second stiffening plate, and a third stiffening plate;

the first stiffening plate being integrated across the neck shaper;

the second stiffening plate being integrated within the first interlocking arm;

the third stiffening plate being integrated within the second interlocking arm;

the first stiffening plate being oriented parallel with the at least one stabilizing plate; and, the first stiffening plate being oriented perpendicular with both the second stiffening plate and the third stiffening plate.

19. The cushioning posterior fulcrum back shaper as claimed in claim 17 comprises:

at least one bed;

the at least one post comprises a shaft, a head, and a stopper plate;

the at least one bed being integrated into the semicircular prismatic body;

the at least one bed traversing from the planar base surface to the at least one post-receiving slot;

the stopper plate being terminally fixed with the shaft;

the head being fixed with the shaft, positioned opposite the stopper plate; and, the head being operatively coupled with the at least one stiffening plate, wherein the head connects the neck shaper with the back shaper within the at least one securing slot, and the stopper plate presses against the at least one stabilizing plate.

20. The cushioning posterior fulcrum back shaper as claimed in claim 1 comprises:

the back shaper comprises a plurality of sipes;

the semicircular prismatic body comprises a planar base surface;

the planar base surface being positioned opposite the rounded lateral surface across the semicircular prismatic body;

the plurality of sipes being integrated into the planar base surface; and, the plurality of sipes laterally traversing along and across the planar base surface.

* * * * *